US005797255A

United States Patent [19]

Saito et al.

[11] Patent Number: 5,797,255

[45] Date of Patent: Aug. 25, 1998

[54] BOBBIN CHANGING METHOD AND APPARATUS

[75] Inventors: Yukio Saito; Kengo Ohashi; Takayuki Morita; Daiji Kasahara, all of Kariya, Japan

[73] Assignee: Kabushiki Kaisha Toyoda Jidoshokki Seisakusho, Kariya, Japan

[21] Appl. No.: 541,677

[22] Filed: Oct. 10, 1995

[51] Int. Cl.[6] ..... D01H 9/10

[52] U.S. Cl. ..... 57/281; 57/267; 57/268; 57/275

[58] Field of Search ..... 57/281, 90, 267, 57/266, 268, 273, 274, 275, 67

[56] References Cited

U.S. PATENT DOCUMENTS

| | | | |
|---|---|---|---|
| 4,369,621 | 1/1983 | Kogiso | 57/267 |
| 5,136,834 | 8/1992 | Stadele | 57/281 |
| 5,222,350 | 6/1993 | Bowman et al. | 57/281 |

FOREIGN PATENT DOCUMENTS

| | | | |
|---|---|---|---|
| 4319173 | 12/1994 | Germany | 57/281 |
| 57-106729 | 7/1982 | Japan . | |
| 58-119562 | 7/1983 | Japan . | |
| 60-5014850 | 4/1985 | Japan | 57/281 |
| 2061117 | 3/1990 | Japan | 57/281 |
| 4352824 | 12/1992 | Japan . | |

*Primary Examiner*—Daniel P. Stodola
*Assistant Examiner*—Tina R. Taylor
*Attorney, Agent, or Firm*—Brooks Haidt Haffner & Delahunty

[57] ABSTRACT

A bobbin changing apparatus for a flyer frame which allows works to freely be performed by attendants at a front side of the flyer frame at any time during the operation of the flyer frame, while eliminating need for providing independent rails for transporting full bobbins and empty bobbins, respectively. Disposed at a front side of a flyer frame (2) is a work platform (35) on which the number of pegs (49) which is twice as large as that of bobbin wheels are mounted with a pitch equal to a half of that of the bobbin wheels (4). Each of the pegs (49) can selectively be disposed at an operative position on a top surface of a cover plate (41) and to a retracted position retracted from the top surface. Further, the pegs can be driven reciprocatively over a distance corresponding to one pitch of the peg array. A bobbin changing mechanism 13 is disposed at a rear side of a bobbin rail 3, while supporting rails are disposed above the flyer frame 2 at the front side thereof so as to be moved up and down by a lift mechanism 7. Bobbin transporting carriers 10 having empty bobbins E for one flyer frame suspended thereof are supported on supporting rails (5, 6). Upon bobbin changing operation, the pegs (49) are disposed at the operative position which allow the full bobbins (F) and the empty bobbins (E) to be exchanged between the bobbin transporting carrier (10) and the bobbin rail by way of the pegs on the work platform (35).

7 Claims, 22 Drawing Sheets

BOBBIN CHANGING METHOD AND APPARATUS

BACKGROUND OF THE INVENTION

1. Field of the Invention

The present invention generally relates to a flyer frame (also referred to as the fly frame or speed frame) equipped with top-supported flyers. More particularly, the invention is concerned with a bobbin changing method and an apparatus for exchanging empty bobbins suspended by bobbin transporting carriers located at a standby position above the flyer frame with full bobbins formed by the flyer frame.

2. Description of Related Art

In recent years, there arises increasingly a trend for implementing the flyer frame which can operate at a high speed in a large package in an effort to enhance the productivity of the flyer frame. Accordingly, the work involved in the doffing operation for taking out the full bobbins from a bobbin rail as well as the work for inserting the empty bobbins to the bobbin wheels not only imposes heavy labor on the workers or operators (inter alia in the doffing operation) but also requires lots of time for the works, providing a cause for lowering the availability or operation efficiency of the-flyer frame. Under the circumstances, there have been made various proposals and approaches for realizing automatically the bobbin changing operation inclusive of the doffing operation as well as the empty bobbin feeding operation performed in succession to the doffing operation.

Heretofore, there has been proposed as the doffing apparatus or the bobbin changing apparatus an apparatus which is composed of a peg conveyor disposed at the front side of the flyer frame and extending over the whole length of the machine frame, bobbin changing arms disposed with a same pitch or interval as the bobbin pitch of the flyer frame, and a bobbin changing machine including a mechanism for moving bobbin changing arms forwardly/backwardly and a bobbin changing arm up/down mechanism for moving the bobbin changing arms and upwardly or downwardly, wherein upon production of full bobbins, the bobbin changing machine is so actuated that the full bobbins are doffed onto the peg conveyor from the bobbin rail of the flyer frame, while the empty bobbins are transferred onto the bobbin rail from the peg conveyor. For more particulars, reference may be made to Japanese Unexamined Patent Application Publication No. 106729/1992 (JP-A-57-106729). In the case of the flyer frame disclosed in the above publication, top surfaces of the bobbin changing heads of the bobbin changing apparatus are covered with a covering member so that when the bobbin changing arms are disposed at the lowermost position, the peg conveyor is covered with the covering member so that the former can also be used as a work platform on which operators or workers can freely move.

In the bobbin changing operation of the apparatus described above, the peg conveyor is driven before formation of the full bobbins while empty bobbins are successively fed onto the peg conveyor at one end thereof to be disposed in opposition to the full bobbins, respectively. Upon finishing of the full bobbins, operation of the flyer frame is stopped. Thereafter, the full bobbins are doffed from the bobbin rail onto the peg conveyor by operating correspondingly the bobbin changing arm moving mechanism and the bobbin changing arm up/down mechanism, whereas the empty bobbins are disposed on the bobbin rail from the peg conveyor.

On the other hand, there is disclosed in Japanese Unexamined Patent Application Publication No. 119562/1963 (JP-A-58-119562) an apparatus which is shown in FIG. 23 of the accompanying drawings. As can be seen in the figure, a rail 102 is disposed above a flyer frame 101 in such orientation as to extend orthogonally to the longitudinal axis of the machine frame which extends orthogonally to the plane of the drawing, wherein a crane 103 is disposed movably along the rail 102. The crane 103 is equipped with transporting rails 104 and 105 each having a length approximately equal to the whole length of the flyer frame 101 and extending in parallel with the machine frame, wherein the transporting rails 104 and 105 are adapted to be moved upwardly or downwardly independent of each other. Disposed on the transporting rails 104 and 105, respectively, are a carriage on which a plurality of bobbin hangers 108 are mounted in an array with a pitch equal to the bobbin pitch of the flyer frame 101. Additionally, disposed at the front side of the flyer frame 101 is a bobbin changer 109 which is movable between a standby position shown in FIG. 23 and an operative position frontward from the standby position which is located closer to the flyer frame 101.

In the bobbin changing operation, the crane 103 is displaced to a position at which the first transporting rail 104 is disposed in opposition to the bobbin changing arms 110 of the bobbin changer 109. In this state, the bobbin changer 109 is moved frontwardly to the operative position at which the full bobbins F on a bobbin rail 111 are suspended by the bobbin changing arms 110, whereupon the bobbin changer 109 is retracted to the standby position with the bobbin changing arms 110 being arrayed in one row. Subsequently, the lift mechanism 106 is actuated to lower the first transporting rail 104. After the full bobbins F having suspended on the bobbin hangers 108, the transporting rail 104 is moved upwardly to be restored to the original position. In succession, the crane 103 is moved to the position at which the second transporting rail 105 carrying the empty bobbins E suspended on the bobbin hangers 108 is positioned in opposition to the tip ends of the bobbin changing arms 110, respectively, upon which the lift mechanism 107 is actuated to lower the second transporting rail 105. After the empty bobbins E having been transferred to the bobbin changing arms 110, the second transporting rail 105 is moved upwardly until the original position is restored. Next, the bobbin changer 109 is moved to the operative position where the empty bobbins E are disposed on the bobbin rail 111 to be retracted to the standby position. Now, the bobbin changing operation has been completed.

In the case of the apparatus disclosed in JP-A-57-106729, the top surface of the bobbin changing head is covered with a covering member so as to be used as a work platform for the operators or workers. In this conjunction, it should however be mentioned that when the operation of the flyer frame is restarted upon completion of the bobbin changing operation for exchanging the full bobbins with the empty bobbins after stopping operation of the flyer frame, there may arise such situation which requires repair works such as connection of broken roves or the like. In this case, it will be noted that during the transportation of the full bobbins as doffed, the covering member mentioned above is moved to a position above a flyer pressor at which the empty bobbins E or full bobbins F can be moved beneath the covering member. Accordingly, during this period, the covering member provides obstacle to the repairing works such as correction of error in automatic rove take-up operation upon restarting of the flyer frame, remedy of breakage of the rove or the like, giving rise to a problem that such repairing works are rendered very difficult or even impossible. Additionally, similar difficulty will be encountered when the covering member is held at the upper or lifted position for allowing the empty bobbins to be transported to the positions corresponding to the bobbin wheels when the full bobbin state is coming up. On the other hand, if the feeding of the empty bobbins and the delivery of the fell bobbins are carried out during a period in which operation of the flyer frame is stopped, the availability or productivity of the flyer frame will remarkably be lowered because the time taken for such bobbin feeding and delivery is considerably longer than the time required for the bobbin changing operation.

On the other hand, in the case of the apparatus disclosed in JP-A-58-119562, the bobbin changer 109 is disposed at the standby position except for the period during which the bobbin changing operation is performed, whereby a passage for the worker can be secured between the flyer frame 101 and the bobbin changer 109. However, this known apparatus suffers from drawback that an extraneous space must be secured for the workers' passage in addition to the space for accommodating installation of the bobbin changing machine. Additionally, the transporting rails 104 and 105 have to be provided for the transportations of the full bobbins F and the empty bobbins E independent of each other, which in turn means that the size of the apparatus as a whole becomes very large, not to say of a problem that the carriages for transportation of the empty bobbins and the full bobbins have to be provided separately.

SUMMARY OF THE INVENTION

In the light of the state of the art described above, it is an object of the present invention to provide a bobbin changing method for a flyer frame which permits the works to be always performed at a front side of the flyer frame during a period in which the flyer frame is operated while allowing the repairing work such as correction of error in the automatic rove take-up upon restarting of operation of the flyer frame, remedy of rove breakage or the like while eliminating the need for providing the transporting rails for transportation of the full bobbins and the empty bobbins independent of each other.

Another object of the present invention is to provide an apparatus for carrying out the method mentioned above.

In view of the above and other objects which will become apparent as the description proceeds, there is provided according to a first aspect of the present invention a bobbin changing method for exchanging full bobbins with empty bobbins in a flyer frame. The flyer frame is equipped with top-supported flyers disposed in a zigzag array in two rows. A number of bobbin supporting members which is twice as large as a number of bobbin wheels of the flyer frame are disposed at a front side of the flyer frame in two rows with a pitch corresponding to a half of a pitch at which the bobbin wheels are disposed. A work platform is disposed so as to be movable along a longitudinal direction of the flyer frame reciprocatively for a distance corresponding to a half of the pitch of the bobbin wheels, wherein the work platform is so arranged as to allow the bobbin supporting members to be exposed upwardly upon bobbin changing operation. Bobbin transporting carriers equipped with bobbin hangers with a pitch corresponding to a half of that of the bobbin wheels are disposed on rails which extend above and along the flyer frame, for suspending the empty bobbins for at least one flyer frame. The bobbin transporting carriers are usually disposed at a standby position.

This bobbin changing method mentioned above includes the steps of transferring the full bobbins from a bobbin rail to the bobbin supporting members of the work platform in a zigzag array by means of a bobbin changer mechanism adapted to move selectively the bobbin changing arms disposed with a half pitch of the bobbin wheels reciprocatively in frontward and rearward directions orthogonally to the flyer frame and then moving the bobbin transporting carriers downwardly to thereby place the empty bobbins onto the bobbin supporting members, moving upwardly the bobbin transporting carriers to the original position after having suspended the full bobbins on bobbin hangers of the bobbin transporting carriers, positioning the two rows of bobbin supporting members having the empty bobbins disposed thereon to a state facing in opposition to the bobbin wheels, and fitting the empty bobbins to the bobbin wheels from the bobbin supporting members by means of the bobbin changing mechanism.

According to the bobbin changing method described above, the bobbin transporting carriers equipped with the bobbin hangers suspending the empty bobbins in a number for at least one flyer frame with a pitch equal to a half of that of the bobbin wheels are disposed on the rails installed above and along the flyer frame at a standby position. Starting from this state, the bobbin changing mechanism is actuated, whereby the full bobbins on the bobbin rail are suspended by the bobbin changing arms and transferred to the bobbin supporting members of the work platform from the bobbin wheels to be disposed in a zigzag array. Furthermore, after the full bobbins on the bobbin supporting members have been suspended by the other bobbin hangers of the bobbin transporting carriers, respectively, the latter are then moved upwardly to the original position. Subsequently, the two rows of bobbin supporting members supporting thereon the empty bobbins, respectively, are disposed in the state in which they face in opposition to the bobbin wheels, and thereafter the bobbin changing mechanism is actuated to thereby transfer and fit the empty bobbins onto the bobbin wheels from the bobbin supporting members, respectively.

Further provided according to a second aspect of the invention is a bobbin changing apparatus for exchanging full bobbins with empty bobbins in a flyer frame, which apparatus includes top-supported flyers disposed in a zigzag array in two rows, a number of bobbin supporting members which is twice as large as a number of bobbin wheels of the flyer frame, the bobbin supporting members being disposed at a front side of the flyer frame in two rows with a pitch corresponding to a half of a pitch at which the bobbin wheels are disposed, a work platform disposed at a front side of the flyer frame so as to be movable along a longitudinal direction of the flyer frame reciprocatively for a distance corresponding to a half of the pitch of the bobbin wheels, the bobbin supporting members being so arranged on the work platform as to be exposed upwardly upon bobbin changing operation, a bobbin changing mechanism including bobbin changing arms capable of holding the bobbins and disposed to be movable among a retracted position, a first operative position corresponding to the bobbin wheels on a bobbin rail and a second operative position corresponding to the bobbin supporting members of the work platform, the bobbin changing mechanism further including driving means for moving the bobbin changing arms selectively to the retracted position and the first and second operative positions, bobbin transporting carriers disposed in front of and above the flyer frame and having a number of bobbin hangers, which number is equal to that of the bobbin wheels of at least one flyer frame, the bobbin hangers being disposed with a pitch equal to a half of that of the bobbin wheels, supporting rails for supporting the bobbin transporting carriers, and a lift means for moving the supporting rails selectively to a lowered position at which the full bobbins mounted on bobbin supporting members of the work platform can be suspended by bobbin hangers and an upper position at which the supporting rails can be connected to transporting rails for delivering the bobbin transporting carriers to other process.

With the structure of the bobbin changing apparatus described above, when operation of the flyer frame is stopped upon completion of the full bobbins, the bobbin changing arms are displaced from the retracted position to the first operative position for doffing the bobbin products disposed on the bobbin rail, whereupon the bobbin changing arms are moved to the second operative position corresponding to the bobbin supporting members of the work platform. At this position, the doffed full bobbins are transferred to the bobbin supporting members, respectively. Subsequently, the supporting rails which support the bobbin transporting carriers are moved downwardly by the lift means. Disposed on the bobbin transporting carriers in a zigzag array are a same number of bobbin hangers as that of the bobbin wheels at least for one flyer frame with a pitch equal to a half of that of the bobbin wheels. By lowering the supporting rails, the empty bobbins suspended on the bobbin transporting carrier are disposed on the bobbin supporting members located adjacent to those having the full bobbins mounted thereon, respectively. After the full bobbins are suspended on the bobbin transporting carriers, the latter are moved to the upper position. Further, after the bobbin supporting members having the empty bobbins mounted thereon are moved to the position corresponding to the bobbin wheels, the bobbin changing mechanism is actuated, whereby the empty bobbins are mounted on the bobbin wheels.

In a preferred mode for carrying out the invention, the bobbin changing mechanism may be disposed below and behind the flyers.

With the arrangement mentioned above, the bobbin changing arms are disposed at the retracted position above the flyers at the rear side thereof. This is advantageous in view of the space demand.

In another preferred mode for carrying out the invention, the bobbin transporting carrier may be so arranged that a number of bobbin hangers which is twice as large as that of the bobbin wheels for at least one flyer frame are arrayed in two rows, and the bobbin hangers of each row may be positioned in opposition to each other with a pitch equal to a half of that of the bobbin wheels.

In the flyer frame implemented in the structure described above, there are suspended on the bobbin transporting carriers the empty bobbins for at least one flyer frame in a zigzag array with the half pitch of the bobbin wheels, and the bobbin hangers having no bobbins suspended thereon are disposed on the supporting rails in the standby state in which the bobbin hangers are suspended similarly in the zigzag array. Thus, when the empty bobbins are disposed on the bobbin supporting members of the work platform at the lowered position of the bobbin transporting carriers, the full bobbins on the adjacent bobbin supporting members can be mounted on the non-occupied bobbin hangers. In this state, the bobbin transporting carriers can be moved upwardly to the original position.

In a further preferred mode for carrying out the invention, the work platform may include a frame structure adapted to be selectively moved upwardly and downwardly by an up/down moving means, a work platform portion secured to the frame structure at a top portion thereof, and rotatable shafts supported on the frame structure at both sides thereof, respectively, and extending along the longitudinal direction of the work platform portion. The bobbin supporting members are fixedly secured to the supporting members supported corotatably with the rotatable shafts so that the bobbin supporting members can be moved between a bobbin holding position corresponding to the top surface of the work platform portion and a retracted position located lower than the work platform portion.

With the structure of the bobbin changing apparatus described above, the work platform can selectively be moved upwardly and downwardly by the up/down moving means together with the frame structure. The rotatable shafts are rotated in precedence to the bobbin changing operation, whereby the bobbin supporting members are displaced to the bobbin holding position corresponding to the top surface of the work platform portion. After the bobbin changing operation, the bobbin supporting members are disposed at the retracted position lower than the work platform portion. Accordingly, the bobbin supporting members assume the retracted position which is lower than that of the work platform portion. Thus, the bobbin supporting members provide no obstacle to the workers, who can thus easily move on the work platform without encountering any obstacle.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
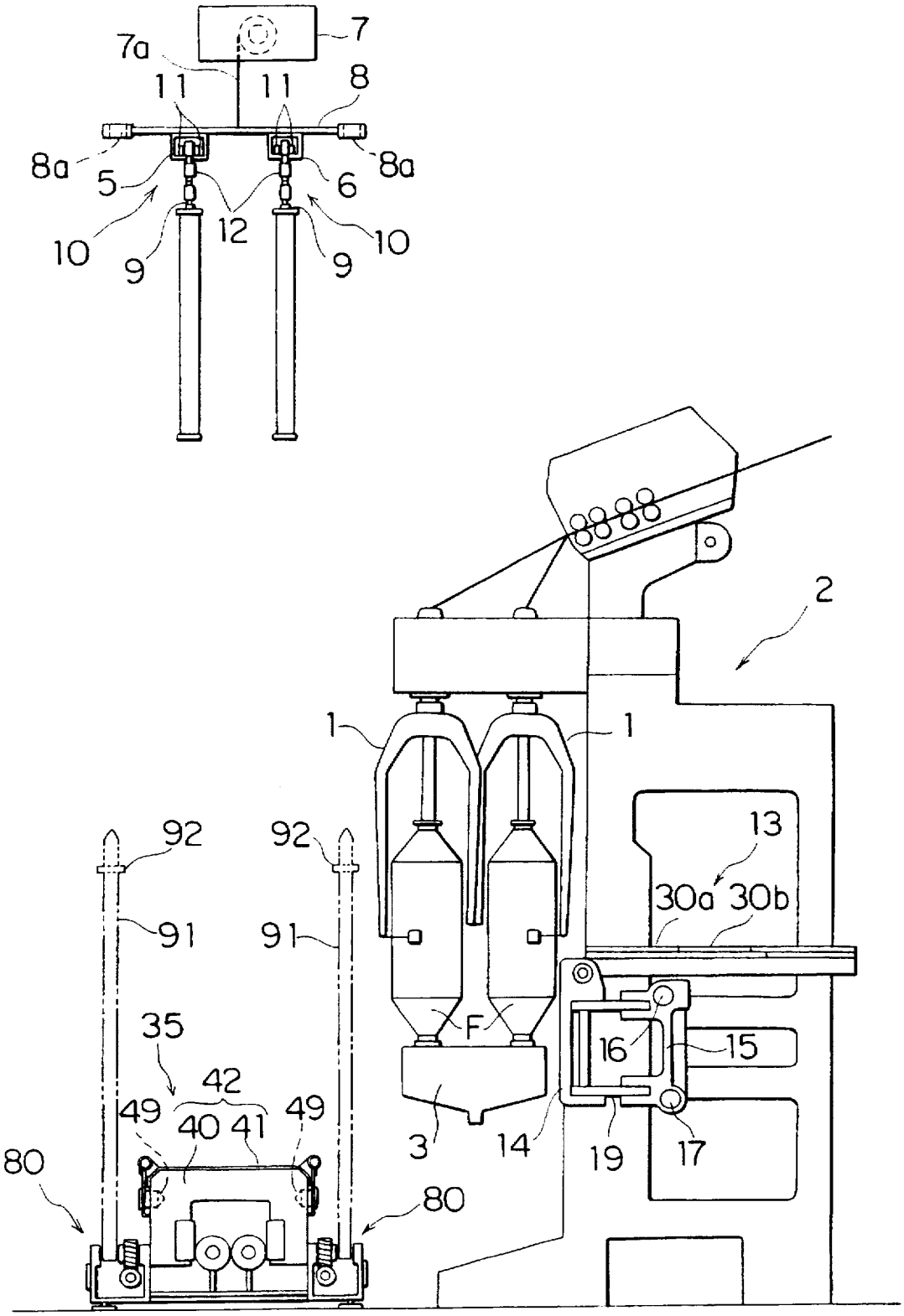
FIG. 1 is a side elevational view showing schematically a structure of a bobbin changing apparatus for a flyer frame according to a first embodiment of the invention.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", "front", "rear" and the like are words of convenience and are not to be construed as limiting terms.

Embodiment 1

Now, referring to FIGS. 1 to 19, description will be made of a bobbin changing apparatus for a flyer frame according to a first embodiment of the invention. Disposed on a bobbin rail 3 of a flyer frame 2 equipped with top supported type flyers 1 are bobbin wheels 4 which are arrayed zig-zag in two rows extending orthogonally to the plane of the drawing (see FIGS. 14 to 16). As can be seen from FIG. 1, a pair of supporting rails 5 and 6 are disposed above the flyer frame 2 at a front side thereof and extend in parallel to a longitudinal axis of the flyer frame 2. More specifically, the supporting rails 5 and 6 are fixedly secured to a supporting frame 8 suspended by a suspending belt 7*a* which is selectively delivered or taken up by a lift mechanism 7 which serves as a lift means. There are formed retaining holes 8*a* in both lateral end portions of the supporting frame 8, respectively. By delivering or winding up the suspending belt 7*a* mentioned above, the supporting rails 5 and 6 are adapted to be vertically moved between a lower position at which empty bobbins E can be exchanged with full bobbins (F) supported on pegs mounted on a work platform (which will be described later on) and an upper position at which the supporting rails 5 and 6 can be operatively connected to transporting rails (not shown) provided for guiding bobbin transporting carriers 10 to a spinning or the like process.

Each of the supporting rails 5 and 6 is provided with the bobbin transporting carriers 10 each including a bobbin hanger 9. The bobbin transporting carrier 10 can freely move or run along the associated supporting rail 5 or 6. More specifically, a plurality of bobbin hangers 9 are adapted to be suspended by the bobbin transporting carrier 10 on the bottom thereof with a distance therebetween which corresponds to the pitch P at which the bobbin wheels 4 are mounted rowwise on the bobbin rail 3. To this end, supporting members 12 each having rollers 11 mounted rotatably at both sides thereof are movably suspended on the rail 5, 6 by means of links (not shown). Thus, each of the bobbin transporting carriers 10 is constituted by the bobbin hanger 9 and the supporting member 12 equipped with a pair of rollers 11. In the case of the apparatus now under consideration, a number of bobbin hangers 9 which is equal to a half of the number of the bobbin wheels 4 for one flyer frame are suspended by each of the bobbin transporting carriers 10, which are introduced into the supporting rails 5 and 6, being mutually displaced by a half pitch P, so that the empty bobbins E suspended by the individual bobbin hangers 9 of the bobbin transporting carriers 10 supported on the supporting rails 5 and 6 are disposed with a distance therebetween which corresponds to the distance between the bobbin wheels 4 in a zigzag array as a whole.

Figure 11:
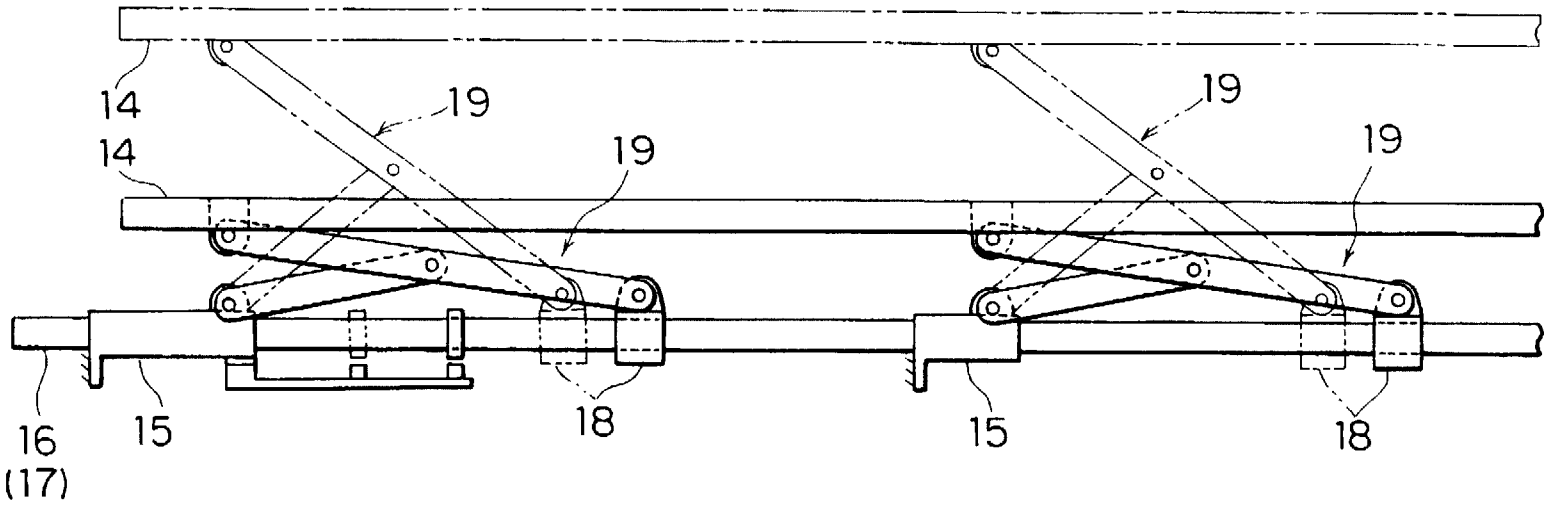
FIG. 11 is a fragmentary plan view showing a bobbin changing mechanism.
Figure 13:
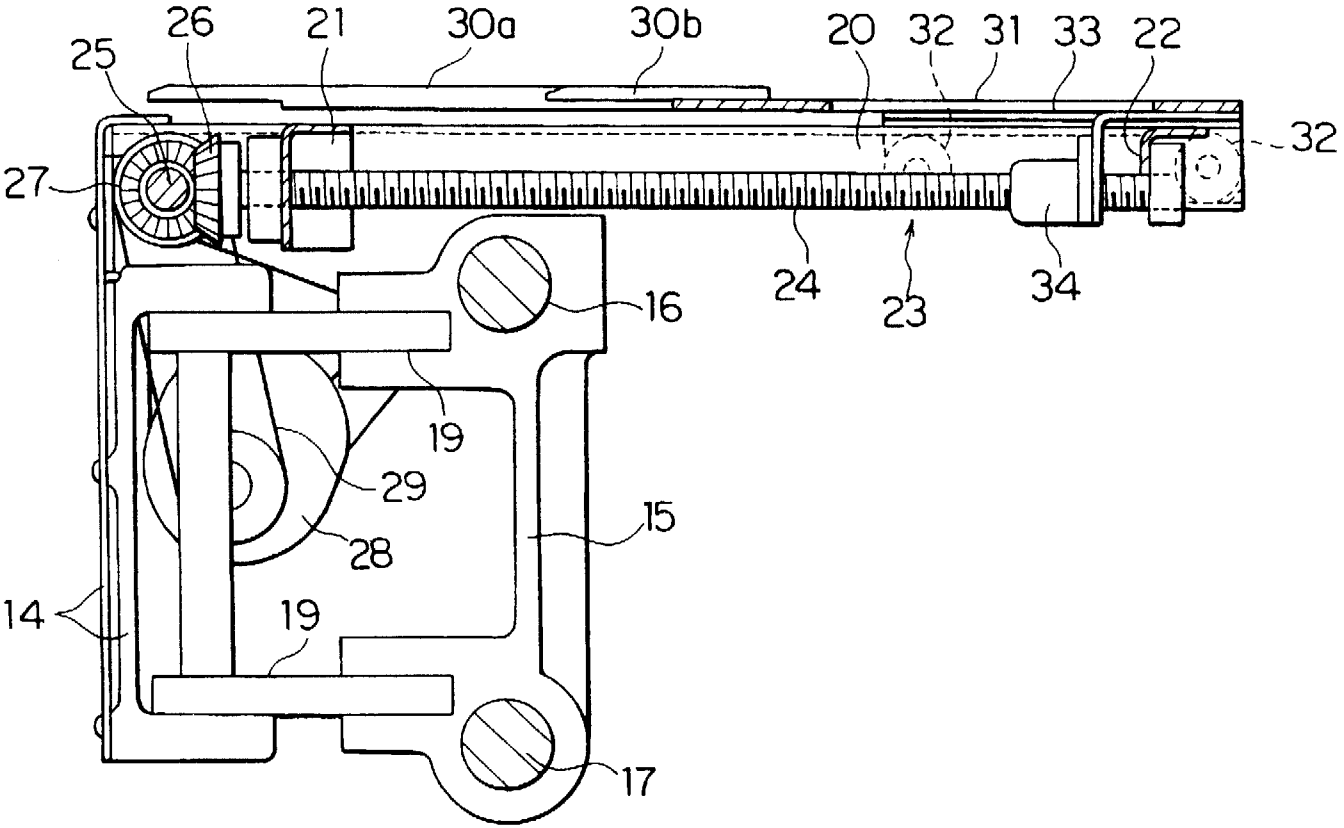
FIG. 13 is a vertical sectional view of the bobbin changing mechanism.

The flyer frame 2 is equipped with a bobbin changing mechanism 13 installed at a rear side of the flyer 1 at a lower position. The bobbin changing mechanism 13 may basically be implemented in a substantially same structure as a bobbin changing apparatus proposed in precedence by the applicant of the present application. In this conjunction, reference may be made to Japanese Unexamined Patent Application Publication No. 352824/1992 (JP-A-4-352824). A doffing bar 14 is disposed to extend over the whole length of the machine frame and is so arranged as to be movable reciprocatively (to the left or right, as viewed in the figure) by making use of a Scott-Russell linear motion mechanism. More specifically, referring to FIG. 13 together with FIG. 1, a pair of shafts 16 and 17 which are aligned in the vertical direction as viewed in FIG. 13 are supported by a plurality of supporting brackets 15 so as to be slideably movable in parallel to the doffing bar 14 in the longitudinal direction of the frame. The supporting brackets 15 in turn above are fixedly secured to the machine frame. Referring to FIG. 11, movable brackets 18 are mounted on the shafts 16 and 17 with a predetermined distance therebetween so that they can be moved together with the shafts 16 and 17. The doffing bar 14 is operatively connected to link mechanisms 19 by means of the supporting bracket 15 and the movable brackets 18. On the other hand, the link mechanism 19 is coupled to the shafts 16 and 17. When the shaft 16 is moved reciprocatively by a power unit (not shown), the doffing bar 14 can be moved exchangeably to a standby position indicated by a solid line in FIG. 11 and to an operative position indicated by a broken line in the same figure.

Figure 12:
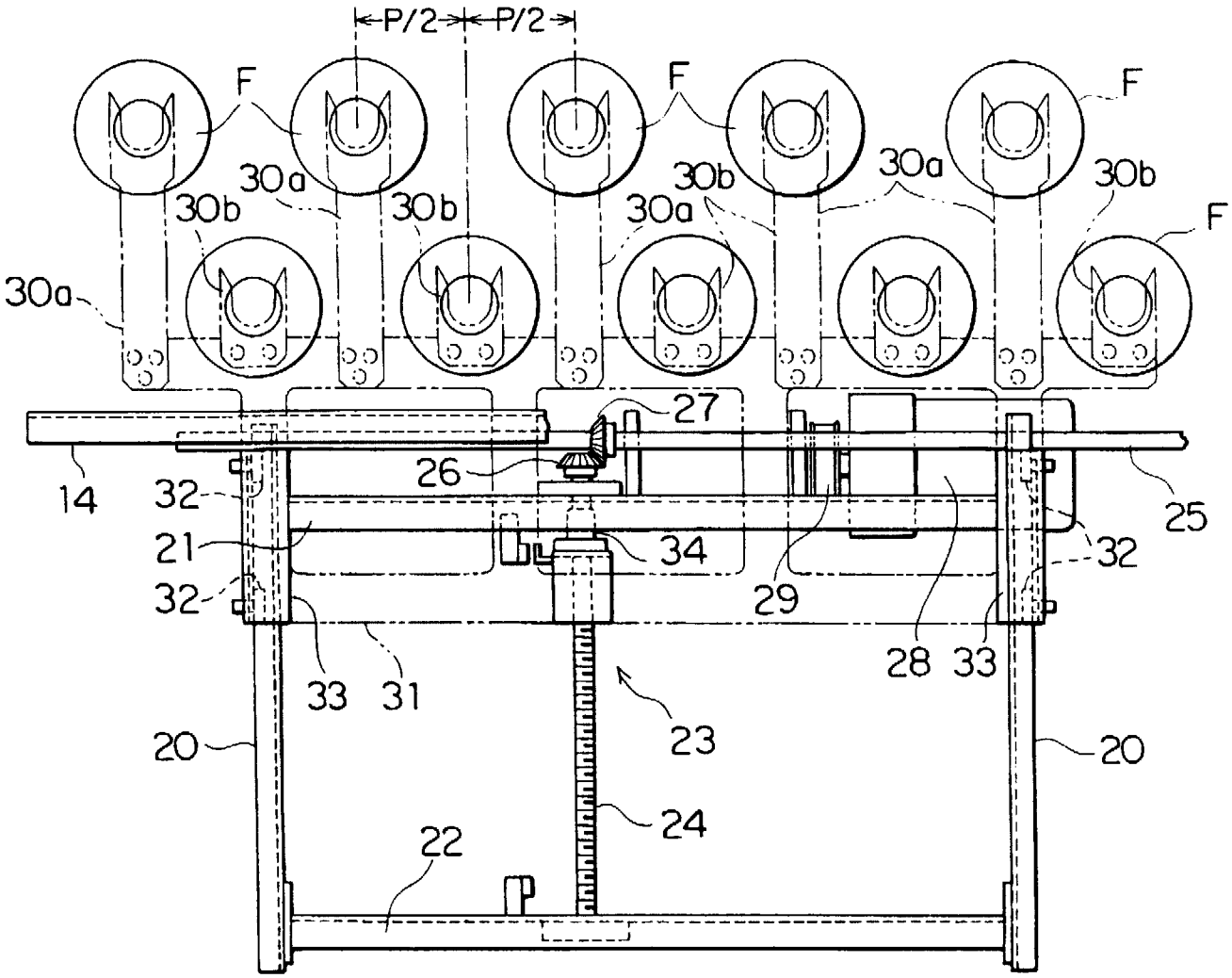
FIG. 12 is a fragmentary plan view showing a bobbin changing mechanism with a portion being broken away.

Next, reference is made to FIGS. 12 and 13. As can be seen from these figures, there are disposed on the doffing bar 14 between the spring pieces (machine frames) constituting the flyer frame 2 (best seen in FIG. 1) a pair of U-like rails 20 which extend rearwardly with a right angle relative to the doffing bar 14 and secured thereto at one ends. Both of the U-like rails 20 are connected to each other by interconnecting bars 21 and 22 in the vicinity of front and rear ends, of the U-like rails 20, respectively, wherein a threaded shaft or screw rod (threaded rod) 24 which constitutes a part of a ball screw mechanism 23 is supported rotatably in a horizontal disposition between the interconnecting bars 21 and 22. Supported on the doffing bar 14 is a rotatable shaft 25 which extends over the whole length of the machine frame in parallel with the doffing bar 14, wherein a bevel gear 27 adapted to mesh with a bevel gear 26 mounted on a tip end of the screw rod 24 is fit on the rotatable shaft 25. The rotatable shaft 25 is adapted to be reversibly rotated by a geared motor 28 mounted on the doffing bar 14 by way of a belt transmission mechanism 29 so that the screw rod 24 can be reversibly rotated in accompanying the rotation of the rotatable shaft 25.

Disposed horizontally above both the U-like rails 20 is a supporting plate 31 which supports forks 30*a* and 30*b* each serving as a bobbin changing arm, wherein supporting brackets 33 are fixedly secured to the lower surface of the supporting plate 31 at both ends thereof, respectively. Each of the supporting brackets 33 has a pair of rollers 32 mounted thereof and adapted to engage with the U-like rail 20. The number of the forks 30*a* and 30*b* secured to the supporting plate 31 at a front side thereof is so selected as to correspond to the flyer pitch (or bobbin wheel pitch, to say in another way). Parenthetically, in the case of the apparatus now under consideration, it is assumed that the number of the forks is ten. Formed in a top surface of each of the forks 30*a* and 30*b* at an inner side is a recess (not shown) in which a collar of an empty bobbin E or a full bobbin F is fit. Furthermore, fixedly secured to the supporting plate 31 substantially at a center portion thereof is a ball nut 34 which constitutes another part of the ball screw mechanism 23 mentioned previously in conjunction with the screw rod 24. By virtue of the arrangement described above, the forks 30*a* and 30*b* can be moved forwardly or rearwardly together with the supporting plate 31 by rotating the geared motor 28 in the forward or backward direction. The link mechanism 19 and the ball screw mechanism 23 cooperate to constitute the driving means of the bobbin changing apparatus according to the invention.

Figure 2:
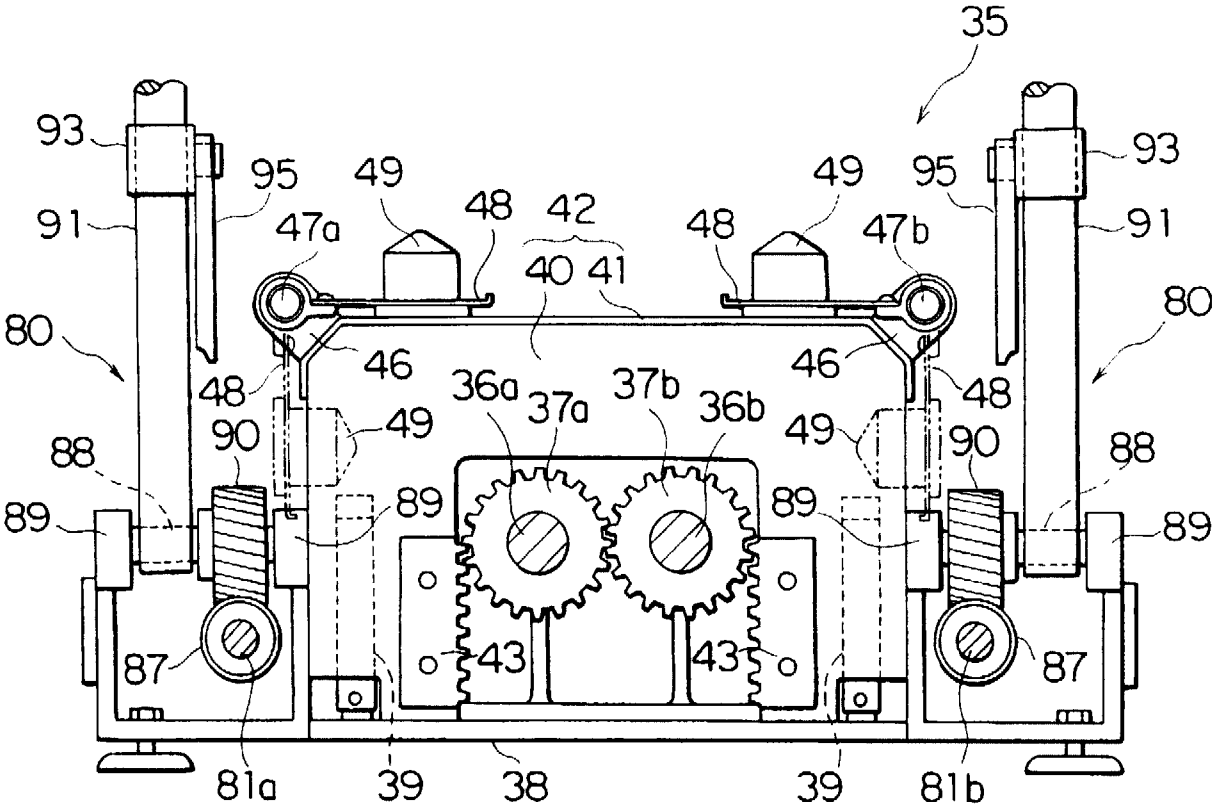
FIG. 2 is a schematic side elevational view showing a work platform of the flyer frame in the state in which a frame structure of the work platform is disposed at a lowered position.
Figure 3:
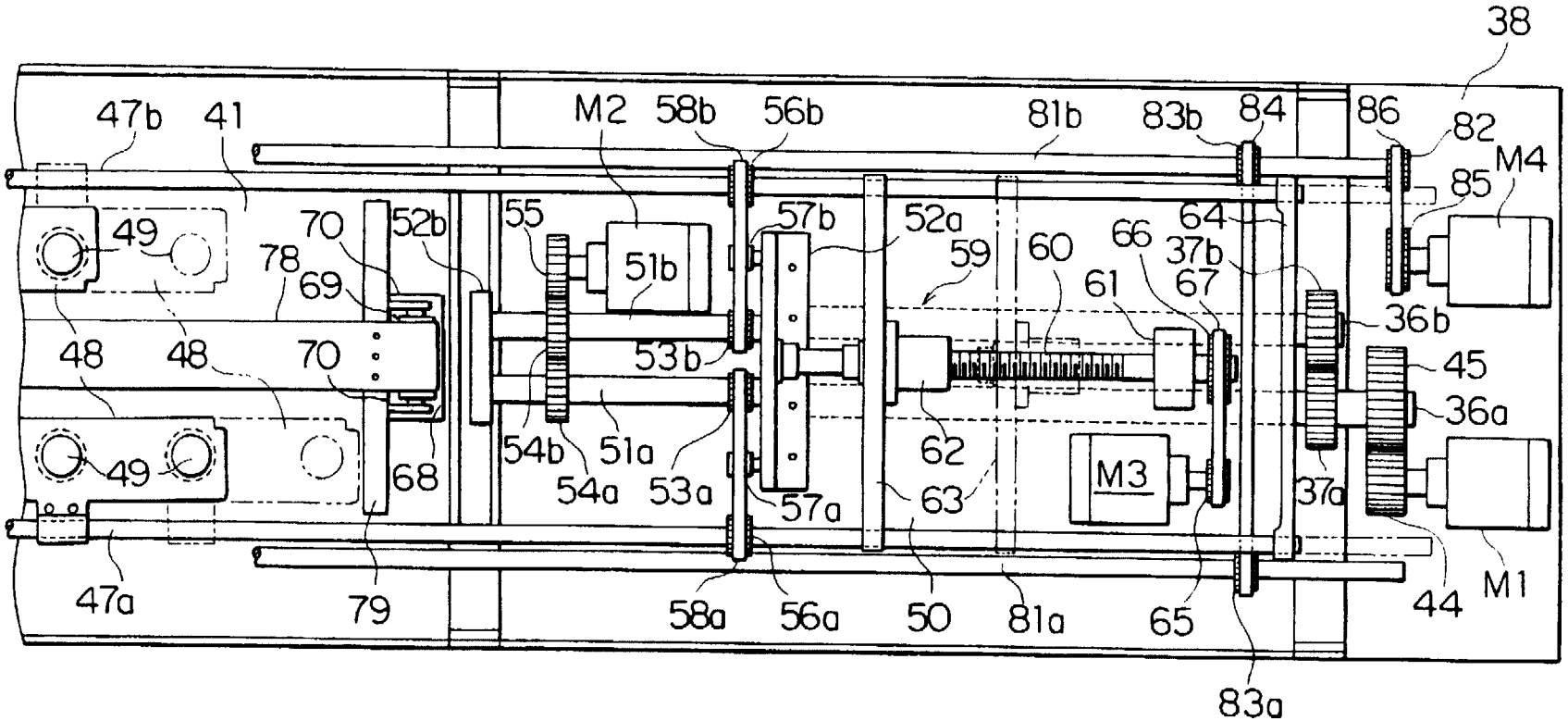
FIG. 3 is a schematic top plan view showing a driving structure for the work platform with a portion being broken away.
Figure 4:
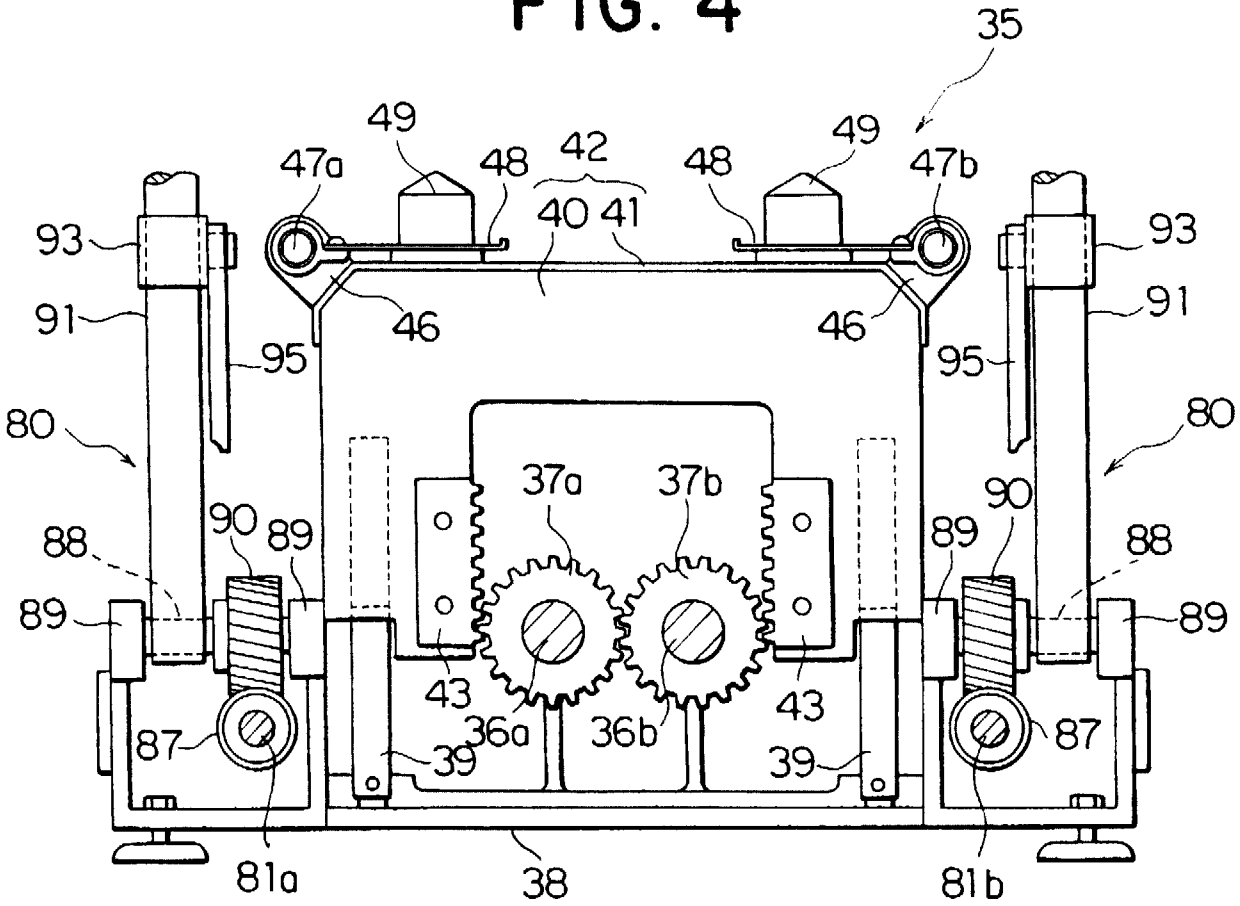
FIG. 4 is a schematic side elevational view similar to FIG. 2, in which a frame structure of the work platform is disposed at a raised position.

Disposed on a floor in front of the flyer frame 2 is a work platform 35 which extends longitudinally of the flyer frame 2 over the whole length of the machine frame. As is shown in FIGS. 2, 3 and 4, there are mounted rotatably a pair of driving shafts 36*a* and 36*b* on the work platform 35 substantially at an inner center portion, which shafts extends substantially over the whole length of the work platform 35. Supported on both the driving shafts 36*a* and 36*b* at a plurality of locations thereof are gears 37*a* and 37*b* with a predetermined distance therebetween, wherein the gears 37*a* and 37*b* mesh with each other and rotate in union with the driving shafts 36*a* and 36*b*, respectively. Plural pairs of upstanding pillars 39 are mounted on a base plate 38 of the work platform 35 with a predetermined distance therebetween in the longitudinal direction of the work platform 35, wherein a plurality of arch-like supporting frames 40 are supported vertically movably by the pairs of supporting pillars 39, respectively. Each of the supporting frames 40 has a cover plate 41 secured at a top thereof and defining a top surface of the work platform. The supporting frames 40 are connected to one another by means of suitable connecting members (not shown) to thereby constitute a frame structure 42. Secured to each of the supporting frames 40 at positions corresponding to the gears 37*a* and 37*b* are a pair of racks 43 which mesh with the gears 37*a* and 37*b*, respectively.

Referring to FIG. 3, mounted on the base plate 38 at a first end portion thereof is a lift-dedicated motor M1 having a driving shaft on which a driving gear 44 is fixedly mounted. As can be seen from FIGS. 3 and 10, the driving gear 44 meshes with a gear 45 which is secured to the driving shaft 36*a* at a first end portion thereof. By rotating the lift-dedicated motor M1 forwardly or backwardly, both the driving shafts 36*a* and 36*b* are reversibly rotated in the corresponding directions, as a result of which the frame structure 42 as a whole is correspondingly moved upwards or downwards. The lift-dedicated motor M1, the driving shafts 36*a* and 36*b*, the gears 37*a* and 37*b*, the rack 43 and so forth cooperate to constitute an up/down driving means of the bobbin changing apparatus according to the present invention.

As can be seen from FIGS. 2 and 3 among others, mounted on the top of the frame structure 42 at both left and right sides thereof are supporting brackets 46 projecting upwardly on which rotatable shafts 47*a* and 47*b* are supported rotatably and movably in the direction along the longitudinal axis of the frame 42. A supporting bar 48 is fixedly secured to each of the rotatable shafts 47*a* and 47*b* so as to be rotatable in union with the rotatable shafts 47*a* and 47*b*, respectively. A number of pegs 49 for one flyer frame 2 are mounted on each of the supporting bars 48 at mutually opposite positions with a pitch corresponding to a half of that of the bobbin wheels 4 (i.e., with a pitch of P/2). In other words, the total number of the pegs 49 of both the supporting bars 48 is twice as large as that of the spindles of the flyer frame 2.

Figure 7:
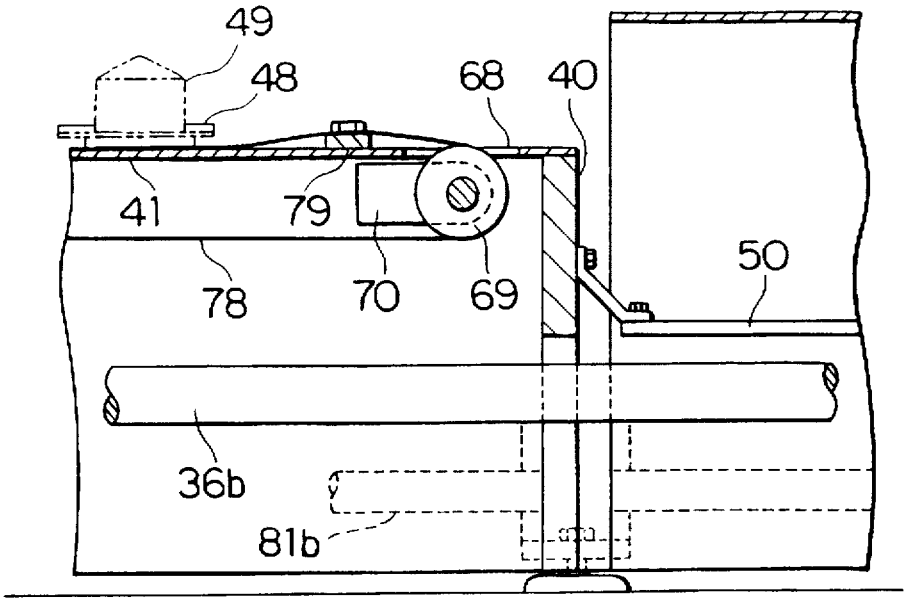
FIG. 7 is a fragmentary sectional view for illustrating a mounted state of a cleaning member.

Now, referring to FIGS. 3 and 7, secured fixedly to the frame structure 42 in the vicinity of the first end thereof and above the driving shafts 36*a* and 36*b* is a supporting plate 50 which is disposed horizontally and which is vertically movable in union with the frame structure 42. A rotation-dedicated motor M2 is fixedly mounted on the supporting plate 50. Further, a pair of intermediate shafts 51*a* and 51*b* are disposed in parallel with the rotatable shafts 47*a* and 47*b* by means of brackets 52*a* and 52*b*, respectively. Both the intermediate shafts 51*a* and 51*b* have first end portions at which pulleys 53*a* and 53*b* are secured and second end portions at which gears 54*a* and 54*b* are fixedly mounted, respectively, so that the pulleys 53*a* and 53*b* and the gears 54*a* and 54*b* can rotate together with the intermediate shafts 51*a* and 51*b*, respectively. Both the gears 54*a* and 54*b* mesh with each other. Besides, the gear 54*b* is adapted to mesh with a driving gear 55 which is secured to the output shaft of the rotation-dedicated motor M2. Pulleys 56*a* and 56*b* are mounted fixedly on the rotatable shafts 47*a* and 47*b* at positions corresponding to the pulleys 53*a* and 53*b*, respectively, so that the pulleys 56*a* and 56*b* can rotate in union and move in the axial direction relative to each other. Now, referring to FIGS. 3 and 9, tension rollers 57*a* and 57*b* are mounted on respective supporting shafts projecting from the bracket 52*a* at positions between the pulleys 53*a* and 56*a* and between the pulleys 53*b* and 56*b*, respectively. The pulleys 53*a* and 56*a* are spanned with a belt 58*a* under tension while the pulleys 53*b* and 56*b* are spanned with a belt 58*b*. When the rotation-dedicated motor M2 is rotated in a given direction, both the rotatable shafts 47*a* and 47*b* are rotated in the mutually opposite directions, respectively, whereby the pegs 49 can be disposed together with the supporting bar 48 selectively at an operative position indicated by a solid line in FIG. 2 or at a retracted position indicated by a broken line in the same figure. At the operative position, the peg 49 is held in the state in which the bottom end thereof bears on the top surface of the cover plate 41, while at the retracted position, the peg 49 is positioned below the rotatable shaft 47*a*, 47*b*.

Disposed above the supporting plate 50 is a screw rod 60 of a ball screw mechanism 59 which is supported rotatably by means of brackets 52*a* and 61 in parallel with the rotatable shafts 47*a* and 47*b*. A supporting bar 63 which supports a ball nut 62 is disposed between the rotatable shafts 47*a* and 47*b* which shafts are both rotatable relative to the supporting bar 63. The first end portions of the rotatable shafts 47*a* and 47*b* are supported slideably on a bracket 64 secured fixedly to the base plate 38. A reciprocation-dedicated motor M3 is fixedly mounted on the supporting plate 50, wherein a pulley 65 fixedly mounted on the output shaft of the reciprocation-dedicated motor M3 and a pulley 66 secured to the screw rod 60 at the first end portion thereof are spanned with a belt 67. The ball screw mechanism 59 is driven by driving the reciprocation-dedicated motor M3 in the forward/backward direction, whereby the supporting bar 63 is caused to move in union with the rotatable shafts 47*a* and 47*b* along the screw rod 60 within a range delimited by the pitch (P/2) of the pegs 49.

Figure 8:
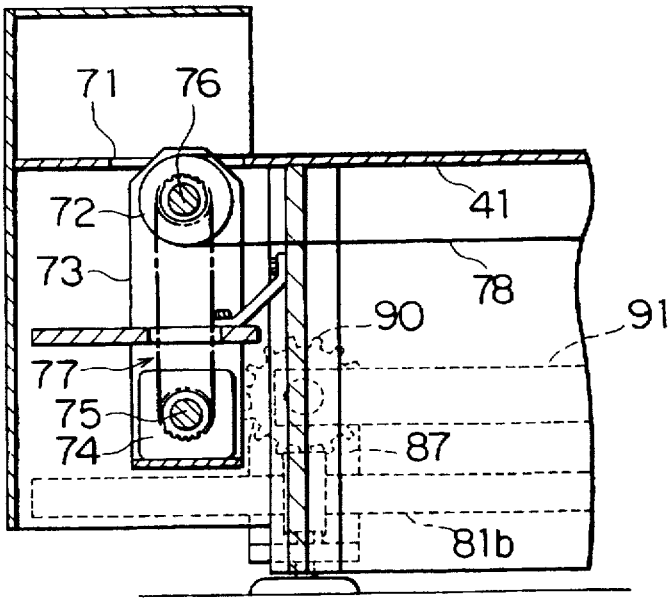
FIG. 8 is a fragmentary sectional view of the work platform.
Figure 9:
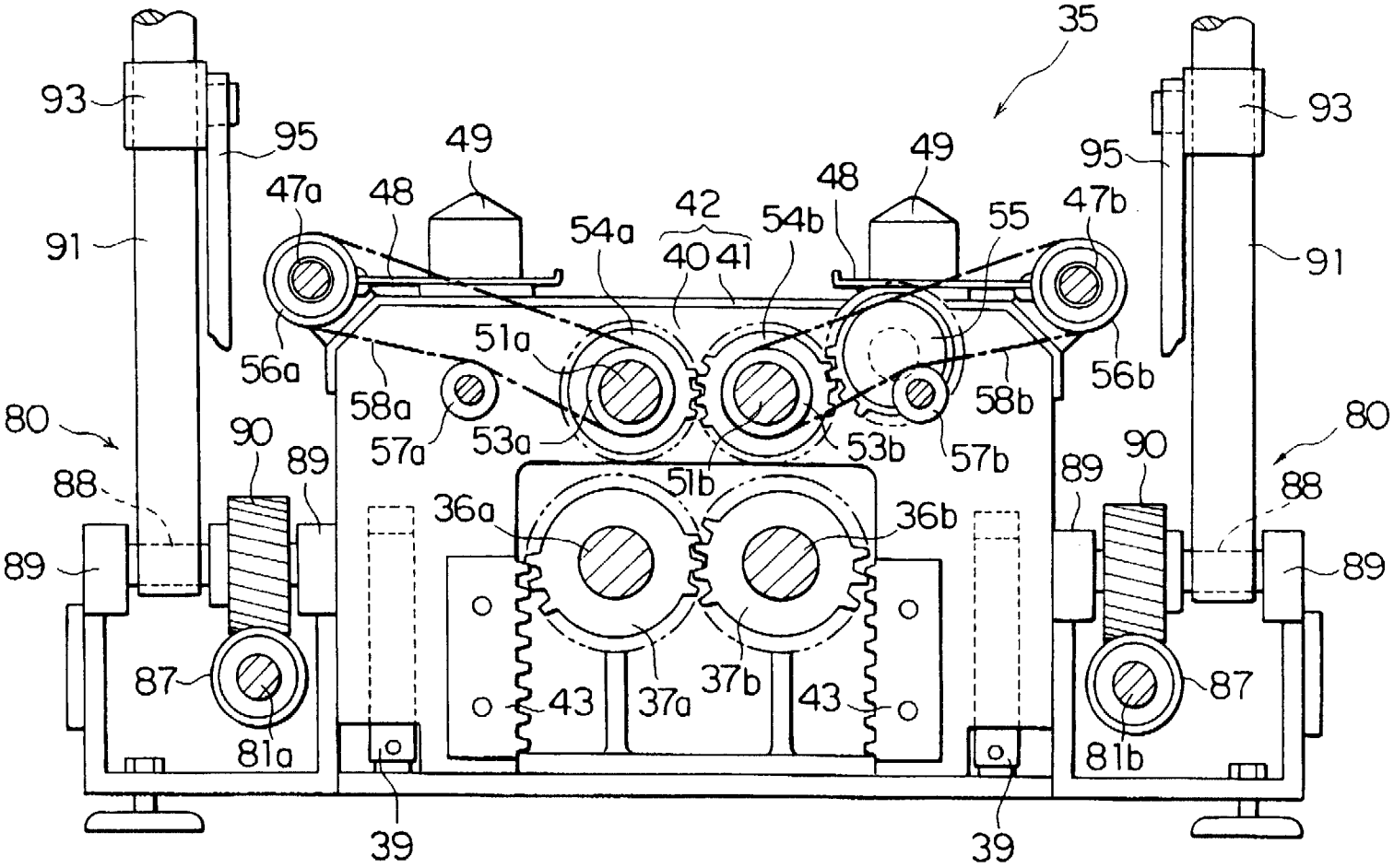
FIG. 9 is a schematic side view showing a driving unit for the work platform.

As is shown in FIGS. 3 and 7, an elongated hole 68 is formed in the cover plate 41 at the first end portion thereof and extends orthogonally to the longitudinal axis of the rotatable shaft 47*a*. A driven pulley 69 is rotatably supported by means of a bracket 70 at a position corresponding to the elongated hole 68 below the cover plate 41. Referring to FIG. 8, another elongated hole 71 is formed at a second end portion of the cover plate 41 so as to extend in the direction orthogonal to the rotatable shaft 47*a*, while a driving pulley 72 is rotatably supported by means of a bracket 73 at a position corresponding to the elongated hole 71 below the cover plate 41. An electric motor 74 is installed beneath the driving pulley 72, wherein a belt transmission mechanism 77 is implemented between the output shaft 75 of the electric motor 74 and a rotatable shaft 76 of the driving pulley 72. The driving pulley 72 and the driven pulley 69 are spanned with a belt 78. In this conjunction, it is to be noted that an upper half of the belt 78 is adapted to move slideably on the top surface of the cover plate 41. Furthermore, a cleaning member 79 is secured in the state abutting the cover plate 41 at the side thereof which corresponds to the belt 78, as shown in FIG. 3 and 7. The cleaning member 79 may be made of a felt material. The cleaning member 79 is usually positioned at the first end portion of the cover plate 41, as shown in FIG. 3, and moved toward the second end portion of the cover plate 41 by driving the electric motor 74 in the forward direction, while it is moved toward the first end of the cover plate 41 when the electric motor 74 is rotated in the backward direction. Sensors (not shown) for detecting the cleaning member 79 are disposed at both ends of the cover plate 41, respectively, so that the electric motor 74 can be stopped in response to the detection signals outputted from these sensors.

Figure 10:
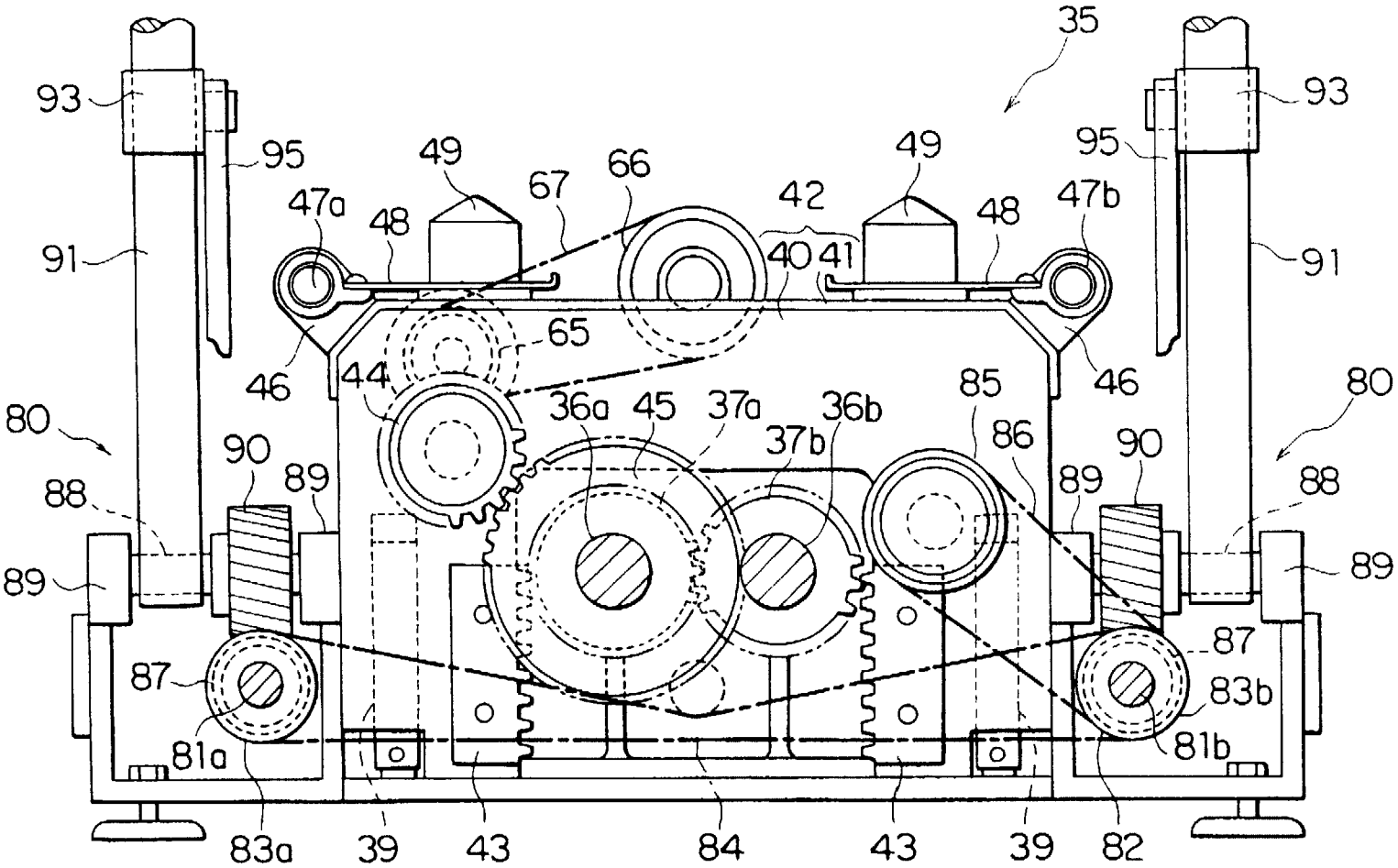
FIG. 10 is a schematic side view showing the driving unit for the work platform.

Next, description will turn to a positioning device 80 which operates when the supporting frame 8 is set to the position for downward displacement. As shown in FIGS. 2, 3 and 10 among others, a pair of rotatable shafts 81*a* and 81*b* are disposed at both outer sides of the frame structure 42 so as to extend in the direction longitudinally of the frame structure 42 in parallel with the rotatable shafts 47*a* and 47*b* and immovably in the vertical direction, wherein a pulley 82 is secured to the rotatable shaft 81*b* at a first end portion thereof so that the pulley 82 can rotate with the rotatable shaft 81*b*. Furthermore, pulleys 83*a* and 83*b* are secured to the rotatable shafts 81*a* and 81*b* in the vicinity of first end portions thereof , respectively, so that the former can rotate together with the latter. Both the pulleys 83*a* and 83*b* are spanned with a belt 84 so as to allow both the rotatable shafts 81*a* and 81*b* to rotate in synchronism with each other. A guide-dedicated motor M4 is fixedly mounted on the base plate 38 at a first end portion thereof, wherein a pulley 85 mounted on the output shaft of the guide-dedicated motor M4 and the pulley 82 are spanned with a belt 86.

Figure 5:
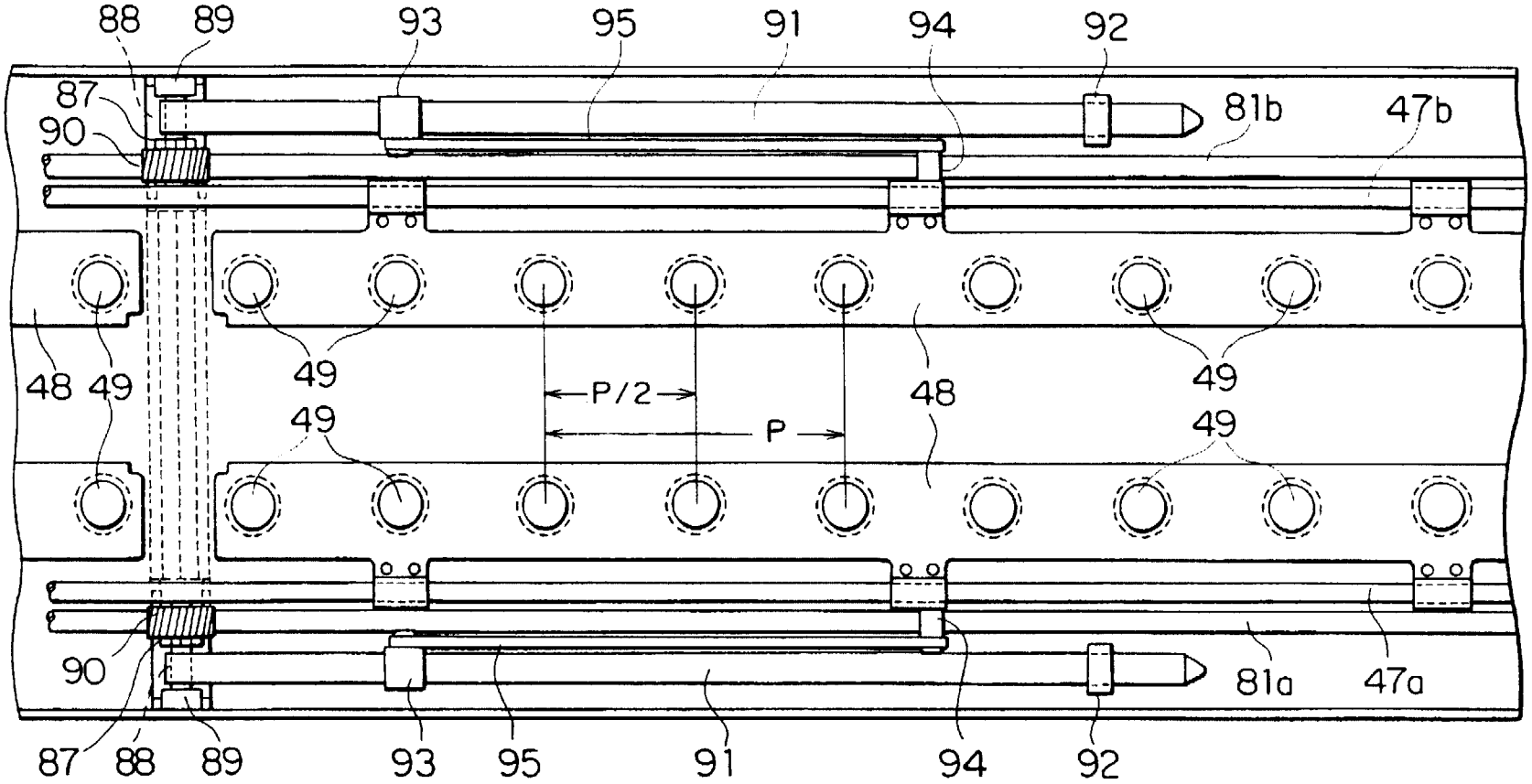
FIG. 5 is a fragmentary top plan view showing schematically a positioning apparatus for the work platform.
Figure 6:
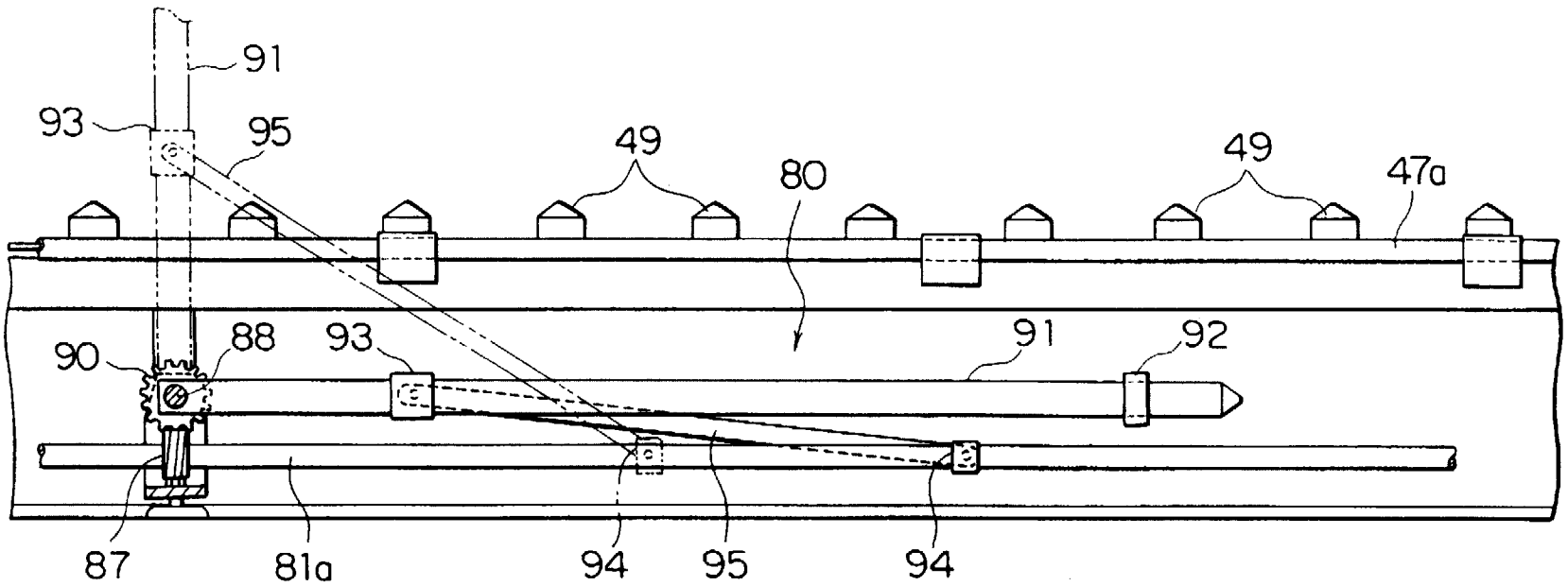
FIG. 6 is a fragmentary front view showing schematically a positioning apparatus for the work platform.

Referring to FIGS. 5, 6 and 10 among others, secured to both the rotatable shafts 81*a* and 81*b* are a plurality of worms 87 with a predetermined distance therebetween so that the worms 87 can rotate with the rotatable shafts 81*a* and 81*b*. Supported rotatably above the rotatable shafts 81*a* and 81*b* at positions corresponding to the worms 87 is a shaft 88 by means of brackets 89 orthogonally to the rotatable shafts 81*a* and 81*b*. Secured to the shaft 88 are a worm wheel 90 which meshes with the worm 87 and a guide rod 91 at a base end portion thereof so that they can rotate in union with each other. Secured fixedly to the guide rod 91 at a tip end thereof by a screw (not shown) is a retaining ring 92 which has a greater outer diameter than a diameter of a retaining hole 8*a* (see FIG. 1) formed in the supporting frame 8. Furthermore, a coupling ring 93 is secured to the guide rod 91 in the vicinity of the base end portion thereof. The guide rods 91 and the rotatable shafts 81*a* and 81*b* have respective first end portions coupled rotatably to the coupling ring 93 and respective second end portions coupled rotatably to a connecting member 94 supported slideably on the rotatable shafts 81*a* and 81*b* by means of link plates 95 supported slideably. When both the rotatable shafts 81*a* and 81*b* are rotated by the guide-dedicated motor M4 in either of the forward and backward (rearward) directions, the guide rod 91 can alternatively assume a retracted position in which the guide rod 91 extends horizontally, as indicated by solid lines in FIGS. 5 and 6, or a guide position indicated by broken lines in FIGS. 1 and 6.

Operations of the lift apparatus 7, (FIG. 1) the bobbin changing mechanism 13, (FIG. 1) and the individual electric motors M1 to M4, (FIG. 3), and 74, (FIG. 8), are controlled by a control apparatus not shown. Further, the timings at which the individual motors M1 to M4 are stopped are determined on the basis of detection signals outputted from the associated sensors not shown either.

Now, description will be directed to operations of the apparatus described above. During operation of the flyer frame 2, the work platform 35 is held in a state in which the frame structure 42 is disposed at the lifted or upper position with the pegs 49 being disposed at the retracted position. Further, the cleaning member 79 is disposed at the retracted position closer to the first end portion of the cover plates 41, as can be seen in FIG. 7. In other words, the work platform 35 is in the state in which operator or worker can freely move on the cover plate 41 to perform works such as repairing of a broken rove and the like without encountering any difficulty.

Furthermore, during operation of the flyer frame 2, the doffing bar 14 is disposed at the standby position, while the supporting plate 31 (see FIG. 12) is disposed at the retracted position with the bobbin changing mechanism 13 being held in the state which provides no obstacle to the take-up (wind-up) of the roves, as shown in FIG. 1. As the operation of the flyer frame 2 progresses, the bobbin transporting carriers 10 suspending the empty bobbins E are moved into the supporting rails 5 and 6 to be thereby disposed at predetermined positions at which the individual empty bobbins E are disposed in opposition to the pegs 49, respectively, which are disposed at the respective operative positions.

Upon formation of full rove bobbins, the spinning and winding-up operations are stopped, and the bobbin rail 3 is moved downwardly to the position at which the collars of full bobbins F are disposed a little above the top surfaces of the forks 30*a* and 30*b*, whereby the automatic cut-off of the roves is carried out. On the other hand, the lift-dedicated motor M1 is driven in the backward or reverse direction to thereby allow the frame structure 42 to be disposed at the lower position. Upon stoppage of the winding-up operation of the flyer frame 2, the electric motor 74 is driven in the forward direction to thereby displace the cleaning member 79 from the first end portion of the cover plate 41 to the second end portion thereof. The cleaning member 79 is stopped at the second end portion of the cover plate 41. Because the cleaning member 79 is caused to move in the state bearing on the top surface of the cover plate 41, fly wastes and the like deposited on the top surface of the cover plate 41 are swept toward the second end portion of the cover plate 41 as the cleaning member 79 is moved, to be ultimately eliminated by a suction apparatus (not shown).

Subsequently, the geared motor 28 is driven in the forward direction to rotate the screw rod 24 forwardly, as a result of which the forks 30*a* and 30*b* move forward together with the supporting plate 31. When the forks 30*a* and 30*b* have reached a predetermined position, operation of the geared motor 28 is stopped in response to a detection signal supplied from a relevant sensor means (not shown), whereby the forks 30*a* and 30*b* are disposed at first operative positions corresponding to the positions of the collars of the individual full bobbins F, respectively. From this state, the bobbin rail 3 is further moved downwardly to the lowermost position, as a result of which the full bobbins F assume the state shown in FIG. 14(A) in which the full bobbins F are suspended by the forks 30*a* and 30*b* and released from the bobbin wheels 4.

Figure 14A:
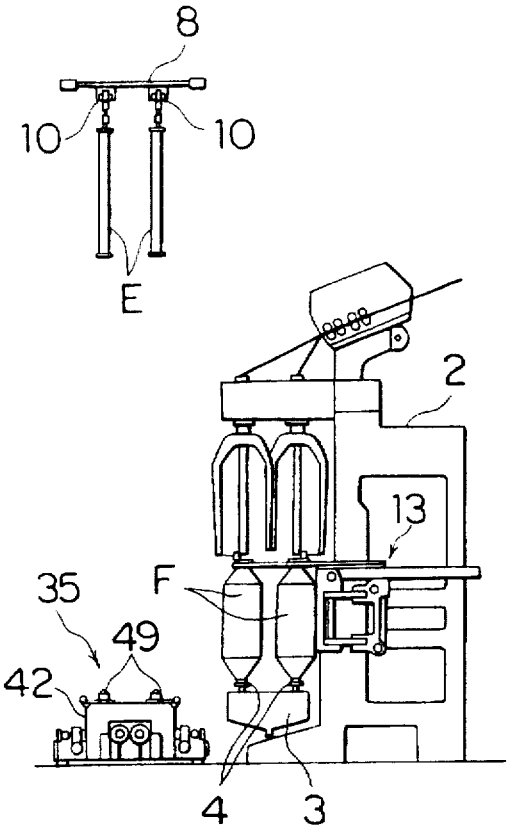
FIGS. 14A to 14D show schematic side views for illustrating bobbin changing operation or process.
Figure 14B:
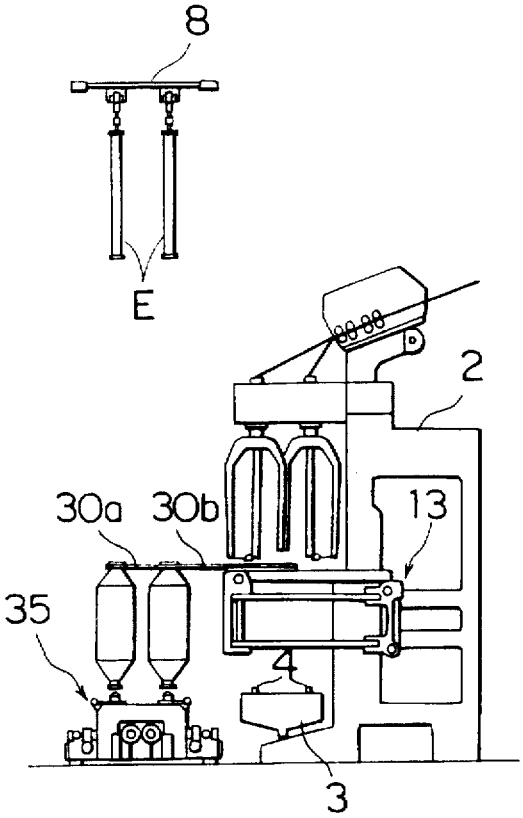

On the other hand, the rotation-dedicated motor M2 is driven forwardly, whereby the supporting bar 48 is revolved together with both the rotatable shafts 47*a* and 47*b* with the pegs 49 being disposed at the operative position, as shown in FIG. 14(A). In this conjunction, it should be mentioned that when the pegs 49 are disposed at the operative position in the state where a large amount of fly wastes is deposited over the cover plate 41, there may arise such situation that the pegs can not assume vertical position under the influence of the fly wastes existing between the pegs 49 and the top surface of the cover plate 41, presenting obstacle to the insertion of the full bobbin F and the empty bobbin E. However, in the case of the apparatus according to the instant embodiment of the invention, the top surface of the cover plate 41 is cleaned before the pegs 49 are disposed at the operative position. Thus, no difficulty will be encountered in the insertion of the full bobbin F and the empty bobbin E. At this time point, the supporting bar 48 is disposed at a position where the peg 49 of the first end position of the supporting bar 48 assumes a position corresponding to the bobbin wheel 4 mounted at the first end portion of the bobbin rail 3 (see the reference line L shown in FIG. 17(A) and others).

Figure 14C:
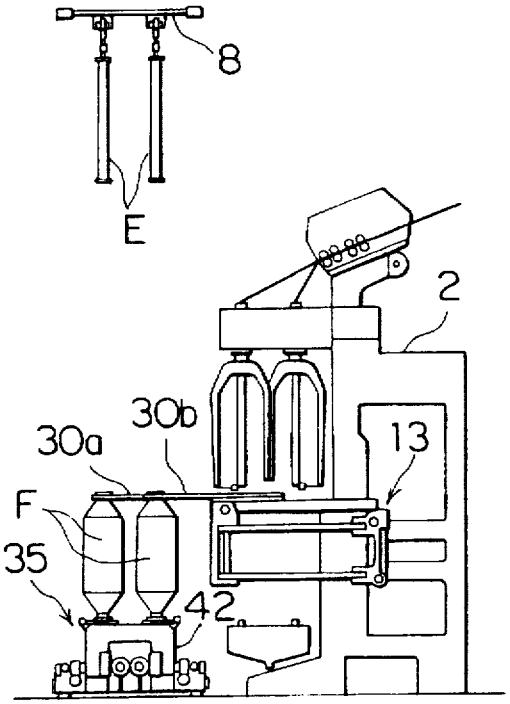
Figure 17A:
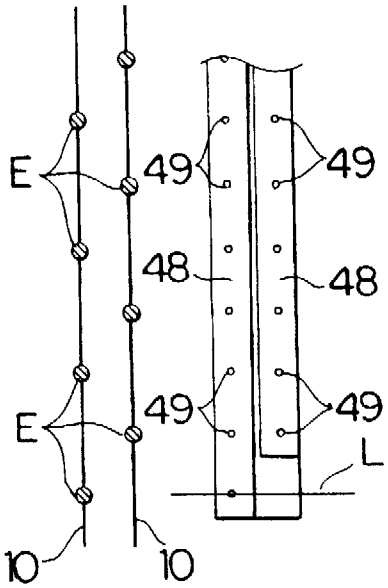
FIGS. 17A to 17D are schematic diagrams for illustrating relations between the work platform and bobbin transporting carriers in a bobbin changing operation phase.
Figure 17A:
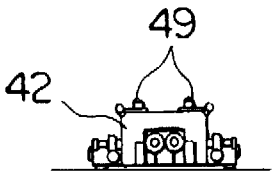
Figure 17B:
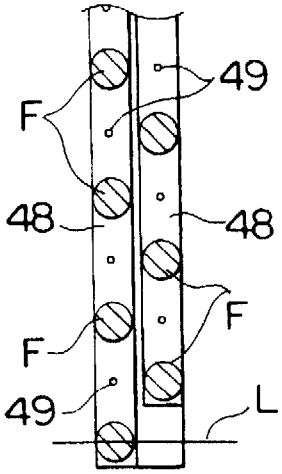
Figure 17B:
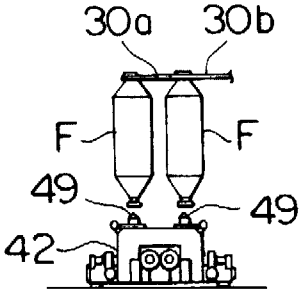
Figure 17C:
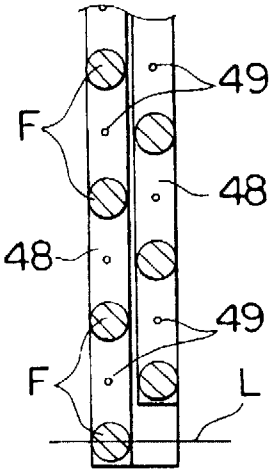
Figure 17C:
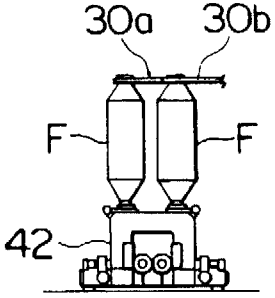

In succession, the power unit is driven to move linearly the shafts 16 and 17 in the forward direction, whereby the doffing bar 14 is caused to move forwardly. Upon reaching of the doffing bar 14 at a predetermined position, the power unit is stopped in response to a detection signal outputted from the relevant position sensor. Then, the forks 30*a* and 30*b* suspending the full bobbins F are disposed at second operative positions which correspond to the pegs 49 of the work platform 35, respectively, to thereby assume the state illustrated in FIGS. 14(B) and 17(B). In this state, the lift-dedicated motor M1 is driven in the forward direction, whereby the frame structure 42 is moved upwardly together with the pegs 49, as a result of which the pegs 49 are, respectively, inserted into the full bobbins F suspended by the forks 30*a* and 30*b*. Thus, the states shown in FIGS. 14(C) and 17(C) are now established. In this state, each of the forks 30*a* and 30*b* can be released from the collar of the full bobbin F.

Figure 14D:
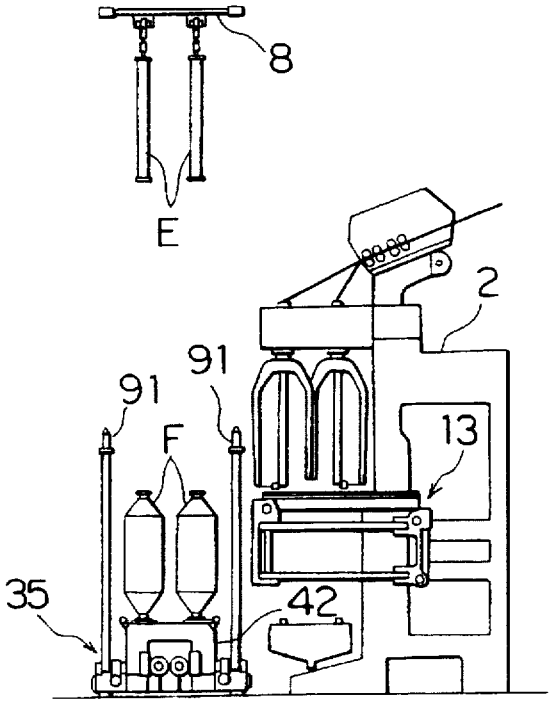
Figure 17D:
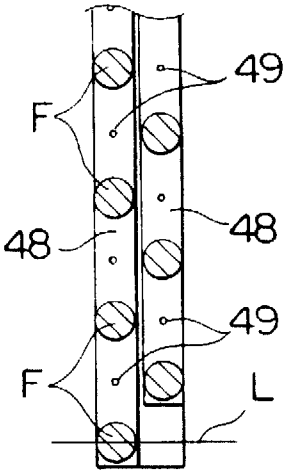
Figure 17D:
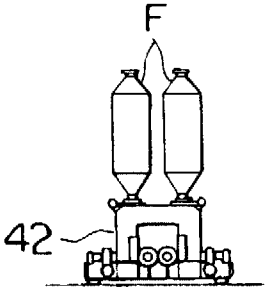

Now, the geared motor 28 is driven in the backward direction to thereby rotate the screw rod 24 in the reverse or backward direction, whereby the forks 30*a* and 30*b* are retracted to the predetermined respective positions, whereupon the geared motor 28 is stopped in response to a detection signal generated by the relevant position sensor. Thus, the forks 30*a* and 30*b* are disposed at the standby position. On the other hand, the guide-dedicated motor M4 is driven in the forward direction to thereby rotate both the rotatable shafts 81*a* and 81*b* such that the guide rod 91 is caused to swing upwardly by way of the worm 87 and the worm wheel 90 from the retracted position to the vertically extending guide position. Thus, the state illustrated in FIGS. 14(D) and 17(D) is attained.

Figure 15A:
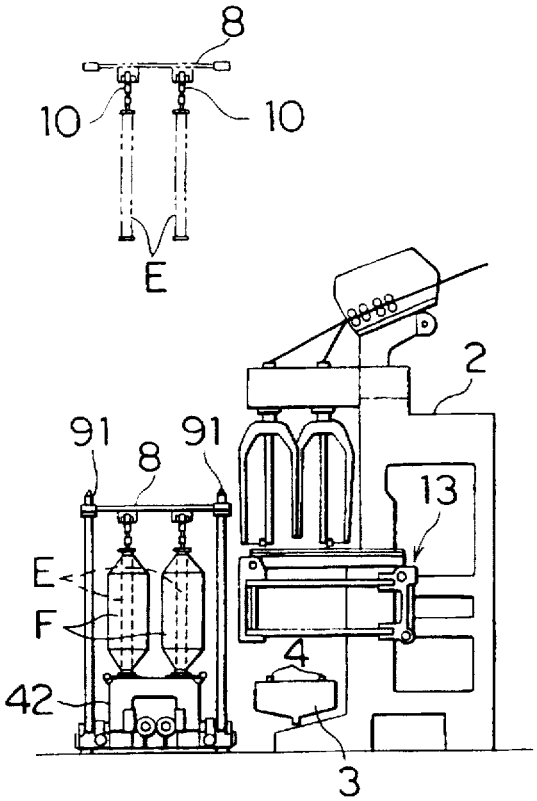
FIGS. 15A to 15D show schematic side views for illustrating bobbin changing process.
Figure 18A:
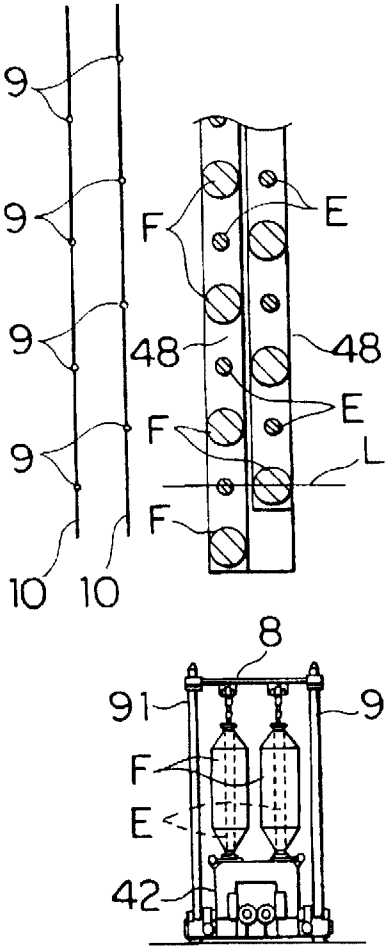
FIGS. 18A to 18D are schematic diagrams for illustrating relations between the work platform and bobbin transporting carriers in a bobbin changing operation phase.

Next, the reciprocation-dedicated motor M3 is driven to thereby rotate the screw rod 60 in the forward direction, whereby the rotatable shafts 47*a* and 47*b* are moved toward the first end portion of the frame structure 42 by the pitch (P/2) of the pegs 49, while the pegs 49 having no full bobbin F inserted thereon are disposed at the positions corresponding to those of the bobbin wheels 4. Subsequently, the lift apparatus 7 is actuated to move the supporting frame 8 downwardly. In the course of moving to the lower position where the empty bobbins E are mounted on the pegs 49, the retaining hole 8*a* of the supporting frame 8 engages with the guide rod 91, whereby the supporting frame 8 is stopped at a predetermined position where the bottom surface of the supporting frame 8 engages with the retaining ring 92. Thus, the empty bobbins E suspended by the bobbin transporting carrier 10 can be inserted onto the pegs 49 without fail, as can be seen in FIGS. 15(A) and 18(A).

Figure 15B:
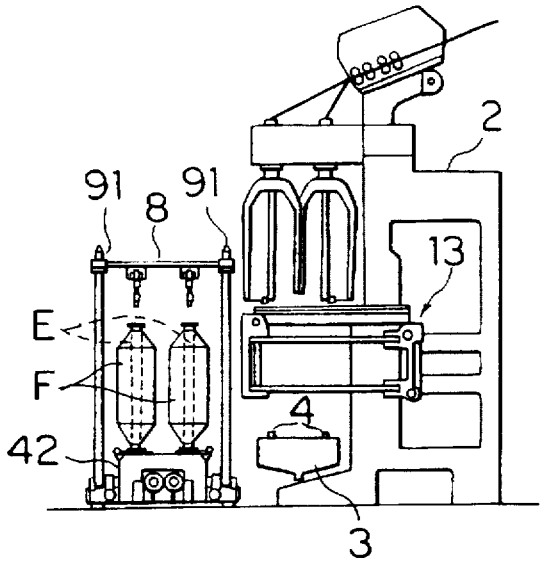
Figure 18B:
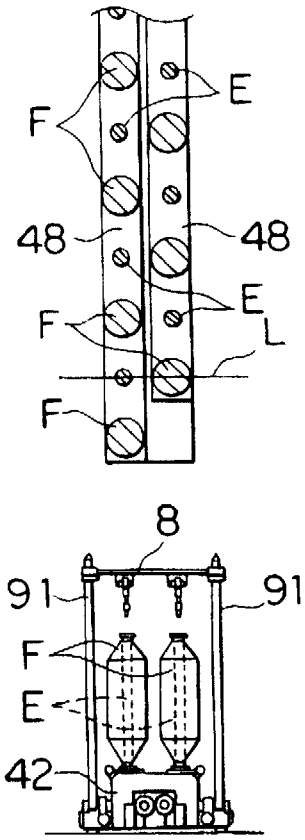

Next, the lift-dedicated motor M1 is driven backwardly to move the pegs 49 downwardly. In the meanwhile, the bobbin hanger 9 and the empty bobbin E are disengaged from each other. Thus, the state in which the full bobbins F and the empty bobbins E are inserted onto the pegs 49 is established, as shown in FIGS. 15(B) and 18(B). When an accident or event that the empty bobbin E fails to release from a bobbin hanger 9 of the bobbin transporting carrier 10 takes place, this event is detected by a relevant sensor (not shown) mounted on the supporting frame 8. In response to an alarm generated by this sensor, the operator can manually release the empty bobbin E and mount it onto the peg 49.

Figure 15C:
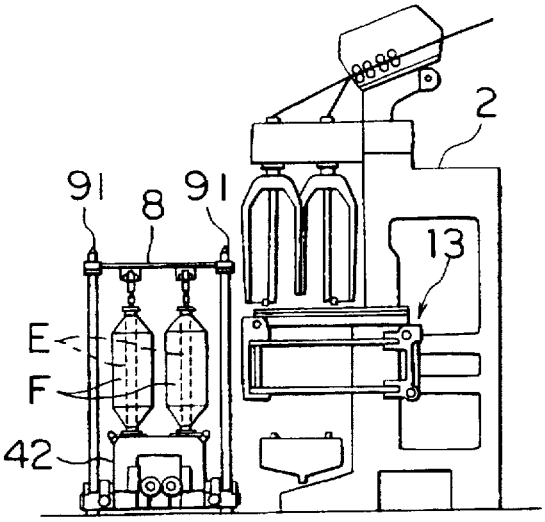
Figure 15D:
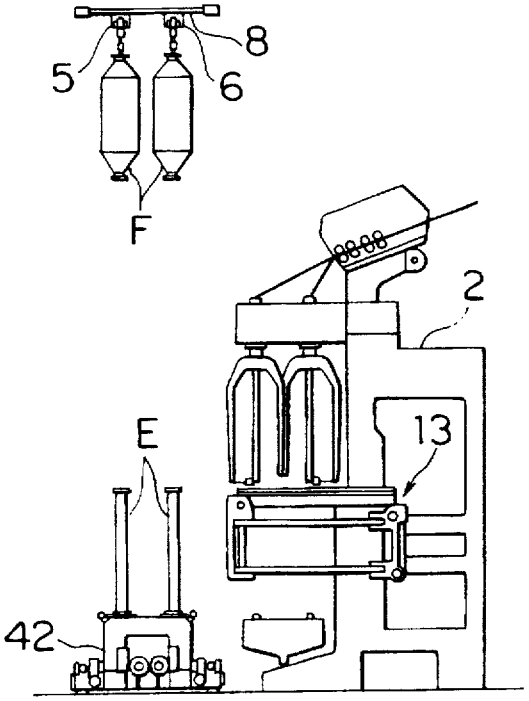
Figure 18C:
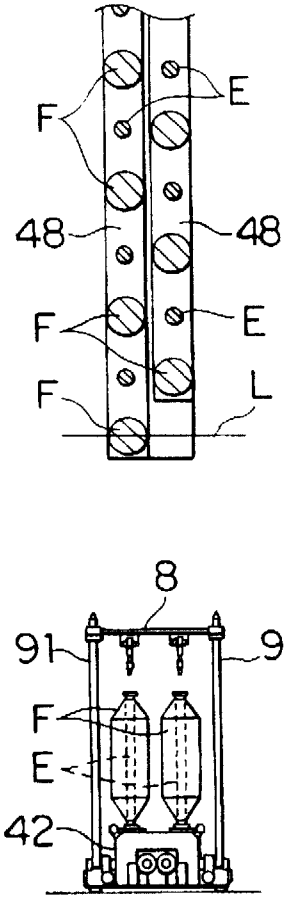
Figure 18D:
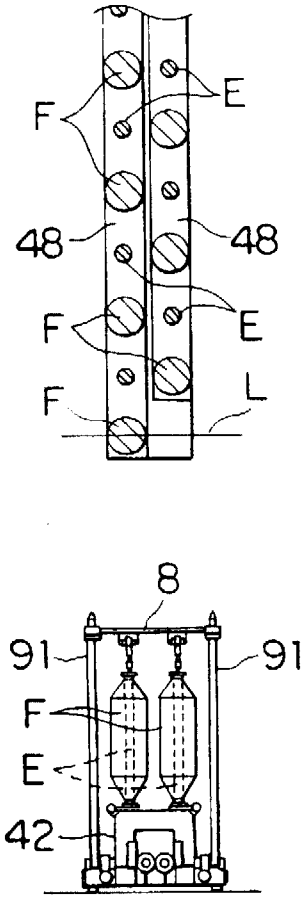

Now, the reciprocation-dedicated motor M3 is driven backwardly. As a result of this, the rotatable shafts 47*a* and 47*b* are caused to move toward the second end portion of the frame structure 42 together with the supporting bar 63 by ½ pitch (P/2) of the bobbin wheels 4 to thereby allow the full bobbins F to assume the positions corresponding to the bobbin hangers 9, respectively, as can be seen in FIG. 18(C). In this state, the lift-dedicated motor M1 is driven in the forward direction to thereby move the pegs 49 upwardly to the position where the full bobbins F can be mounted on the bobbin hangers 9, respectively, as shown in FIGS. 15(C) and 18(D). Subsequently, the lift apparatus 7 is actuated to thereby move the supporting frame 8 upwardly to the original position. In succession, the guide-dedicated motor M4 is driven in the backward direction, whereby the guide rod 91 is caused to swing to the retracted position. Thus, the state shown in FIG. 15(D) is established.

Figure 16A:
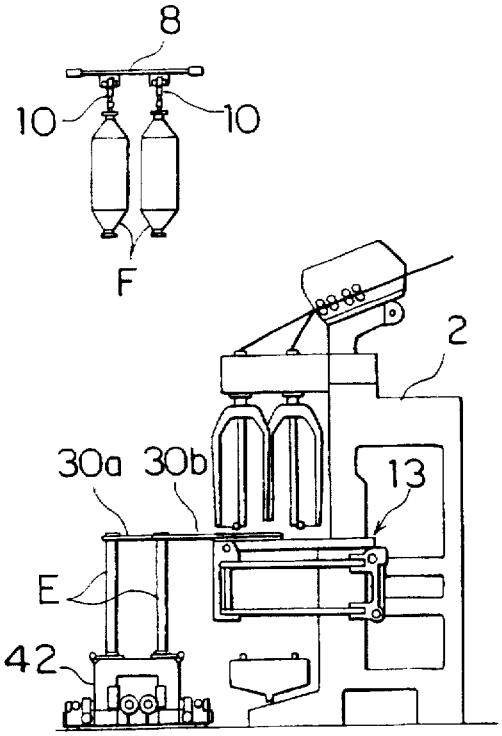
FIGS. 16A to 16D show schematic side views for illustrating bobbin changing process.
Figure 16B:
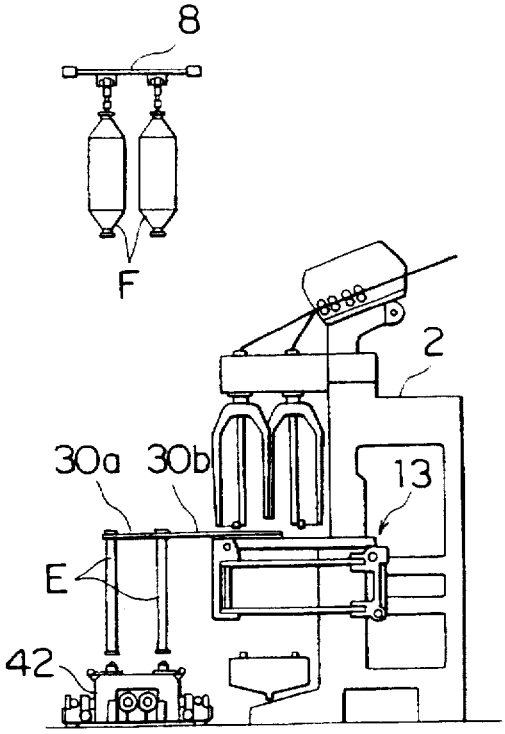
Figure 19A:
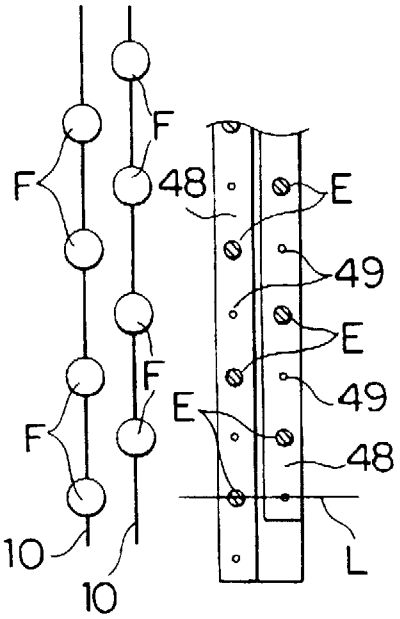
FIGS. 19A to 19D are schematic diagrams for illustrating relations between the work platform and bobbin transporting carriers in another bobbin changing operation phase.
Figure 19B:
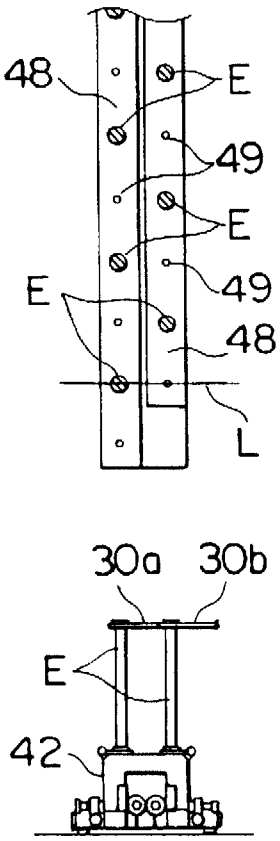
Figure 19C:
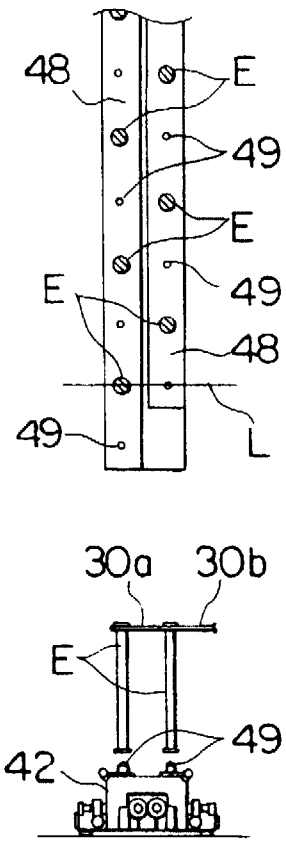

Subsequently, the reciprocation-dedicated motor M3 is driven forwardly, as a result of which the rotatable shafts 47*a* and 47*b* are caused to move toward the first end portion of the frame structure 42 together with the supporting bar 63 by ½ pitch (P/2) of the bobbin wheel 4. Thus, the empty bobbins E are brought to the positions corresponding to the forks 30*a* and 30*b*, as can be seen in FIG. 19(A). Next, the geared motor 28 is again driven forwardly to move the forks 30*a* and 30*b* in the forward direction. The forks 30*a* and 30*b* are stopped at a time point at which they assume the positions underlying the collars of the empty bobbins E, as shown in FIGS. 16(A) and 19(A). In this state, the lift-dedicated motor M1 is driven backwardly. Thus, the pegs 49 are lowered together with the frame structure 42, whereby the pegs 49 and the empty bobbins E are disengaged from each other. Thus, the empty bobbins E assume the state in which they are suspended by the forks 30*a* and 30*b*, respectively, as can be seen in FIGS. 16(*b*) and 19(*c*).

Figure 16C:
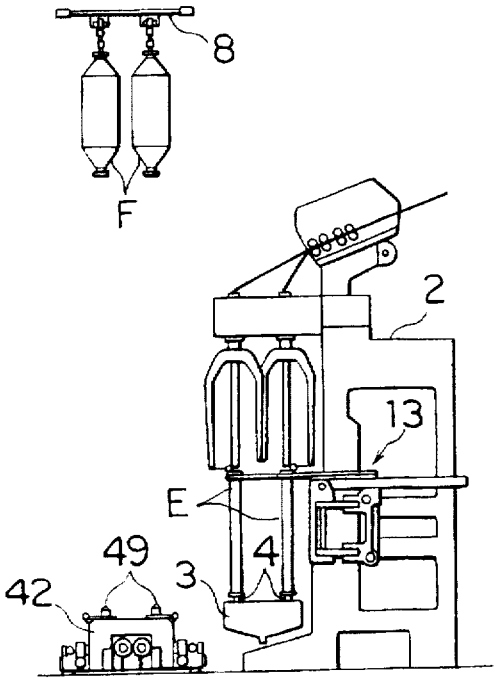
Figure 16D:
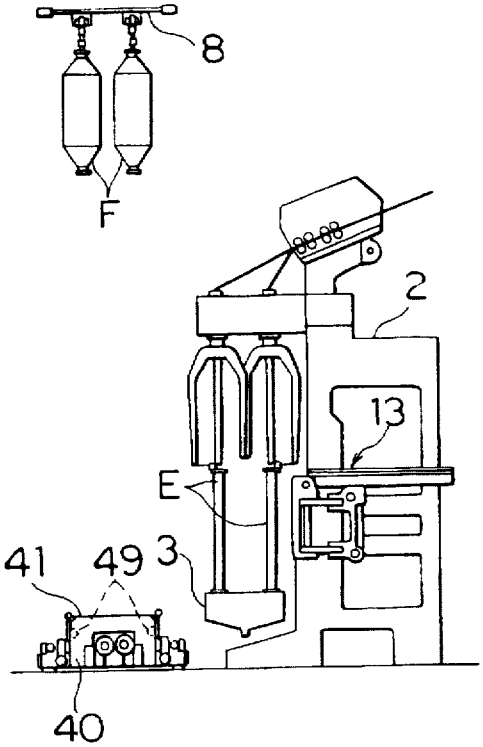
Figure 19D:
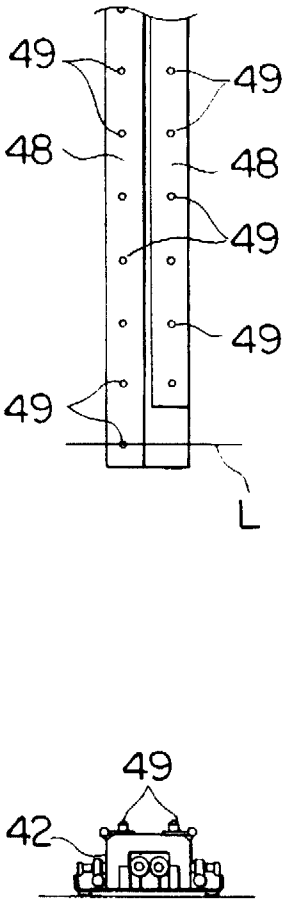

Now, the power unit (not shown) is driven to thereby move the shafts 16 and 17 backwardly to retract the doffing bar 14. Upon arrival of the doffing bar 14 at the predetermined standby position, operation of the power unit is stopped in response to the detection signal outputted from the relevant sensor (not shown). The forks 30*a* and 30*b* supporting the empty bobbins E in the suspended state thereof are disposed at the operative positions corresponding to the bobbin wheels 4, respectively. This state is illustrated in FIG. 16(C). Subsequently, the bobbin rail 3 is lifted. After the bottom portions of the empty bobbins E are caught by the bobbin wheels 4, the bobbin rail 3 is stopped at a time point at which the bobbin rail 3 has been lifted to the position where the collar of the empty bobbin E is disengaged from the forks 30*a* and 30*b*. Thereafter, the geared motor 28 is driven backwardly to allow the forks 30*a* and 30*b* to move to the predetermined retracted position, as shown in FIG. 16(D), which is then followed by driving backwardly the reciprocation-dedicated motor M3 until the peg 49 located at the first end portion of the frame structure 42 assumes the position corresponding to the reference line L. This state is illustrated in FIG. 19(D). Furthermore, the rotation-dedicated motor M2 is driven in the backward direction to thereby allow the pegs 49 to be disposed at the retracted position, while the lift-dedicated motor M1 is driven in the forward direction to thereby dispose the frame structure 42 at the lifted position. Thus, the state shown in FIG. 1 is restored. Additionally, after the pegs 49 have been disposed at the retracted position, the electric motor 74 is driven in the reverse or backward direction, whereby the cleaning member 79 is caused to displace from the second end portion of the cover plate 41 to the first end portion thereof to restore the retracted position closer to the first end portion of the cover plate 41.

After the bobbin rail 3 has been lifted to the rove wind-up position, the spinning operation is started. The bobbin transporting carriers 10 supporting the full bobbins F in the suspended state thereof are then transported to a spinning process outwardly from the supporting rails 5 and 6. Thereafter, the succeeding bobbin transporting carriers 10 suspending the empty bobbins E are received or accommodated.

As is apparent from the foregoing description, in the fly frame 2 according to the instant embodiment of the invention, there is disposed at the front side of the flyer frame 2 the work platform 35 on which the full bobbins F and the empty bobbins E are temporarily or transiently disposed during the cop or bobbin changing process. However, there arises neither the possibility of the empty bobbins E being preparatorily disposed on the work platform 35 during the spinning operation nor the possibility that the transfer of the doffed full bobbins F from the work platform 35 is carried out with a delay to intervene the restart of operation of the flyer frame 2. In other words, the work platform 35 can freely be used without any obstacle during the spinning operation, which in turn means that there is no necessity of securing a passage for the operators or workers or a space for repairing the broken roves or the like. Besides, the need for provision of transportation rails for transporting the full bobbins F and the empty bobbins E independent of each other can be eliminated.

Furthermore, since the bobbin changing mechanism 13 is disposed at the space available at the rear side of the flyer frame 2 in the case of the instant embodiment of the invention, there arises no necessity of disposing the cop or bobbin changer at the front side of the flyer frame 2. Thus, the demand for the space for installation of the flyer frame 2 can be obviated as a whole.

Besides, by virtue of such arrangement that the pegs 49 provided in association with the work platform 35 are moved upwardly and downwardly, the bobbin transfer operation between the forks 30*a*, 30*b* and the pegs 49 can be realized without need for provision of a mechanism for moving vertically the forks 30*a* and 30*b*, which of course contributes to the simplified implementation of the bobbin changing mechanism 13. Additionally, because the pegs 49 are moved upwardly and downwardly in the operation for transferring exchangeably the empty bobbins E and the full bobbins F between the bobbin transporting carrier 10 and the work platform 35, the transfer operation as well as the control process can significantly be simplified when compared with such structure in which the bobbin transporting carriers 10 are moved upwardly and downwardly.

Moreover, since the work platform 35 of the flyer frame 2 according to the instant embodiment of the invention is equipped with the positioning device 80 which is operated upon disposition of the supporting rails 5 and 6 at the lowered position, the bobbin transporting carriers 10 supporting the empty bobbins E in the suspended state thereof can be disposed at the predetermined lowered position without fail. Owing to this arrangement, probability of the empty bobbin E being inadvertently released from the bobbin hanger 9 as well as erroneous fitting of the full bobbin F to the bobbin hanger 9 can be suppressed to a minimum.

Embodiment 2

Figure 20A:
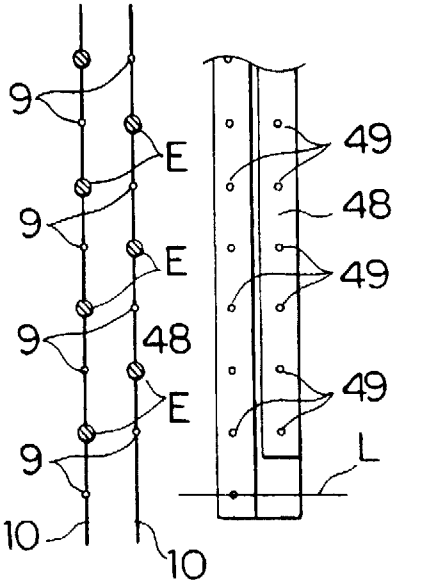
FIGS. 20A to 20D are schematic diagrams for illustrating relations between the work platform and bobbin transporting carriers in a bobbin changing apparatus of a flyer frame according to a second embodiment of the invention.

Next, a second exemplary embodiment of the present invention will be described by reference to FIGS. 20 to 22. In the first place, it should be mentioned the second embodiment now under consideration differs from the apparatus according to the first embodiment of the invention in respect to the structure of the bobbin transporting carrier 10 and is identical with the latter with regards to the structures of the bobbin changing mechanism 13, the work platform 35 and the positioning device 80. More specifically, the bobbin transporting carrier 10 according to the instant embodiment of the invention is equipped with the bobbin hangers 9 in a number twice as large as that of the bobbin wheels 4 for one flyer frame 2 in two rows such that the bobbin hangers 9 are disposed in opposition to each other with half of the pitch P of the bobbin wheels 4, as can be seen in FIG. 20(A) and others. Furthermore, the bobbin transporting carriers 10 are disposed at such position that the leading bobbin hanger 9 assumes the position corresponding to the reference line L in the state in which the empty bobbins E are suspended by every other bobbin hanger 9, as is shown in FIG. 20(A).

Figure 20B:
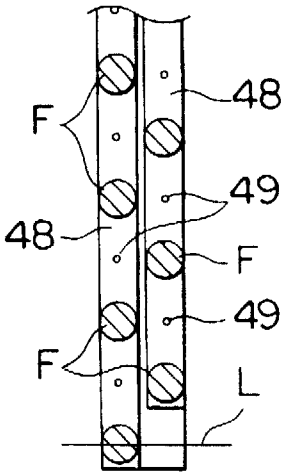
Figure 20B:
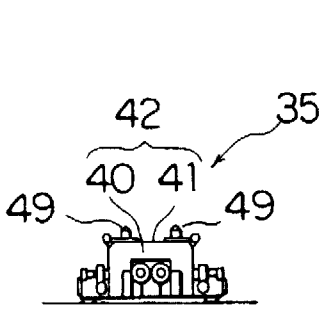
Figure 20C:
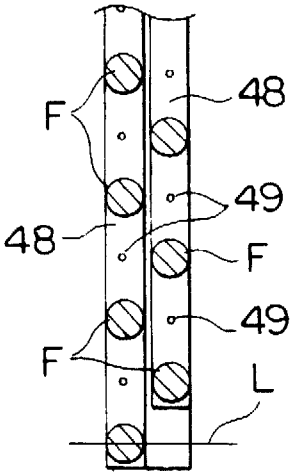
Figure 20C:
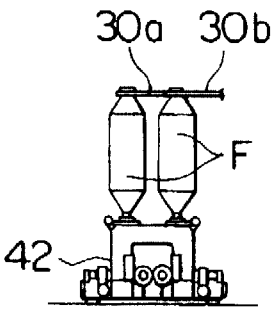
Figure 20D:
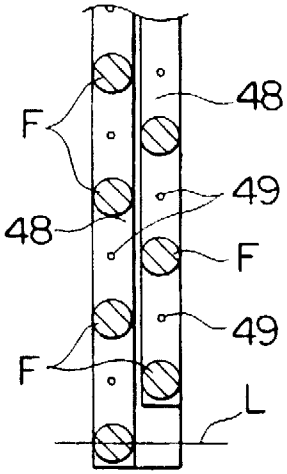
Figure 20D:
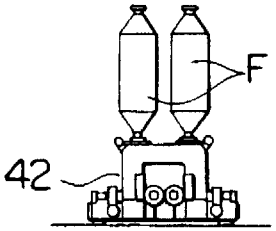

In the apparatus according to the instant embodiment of the invention, the procedure for mounting the full bobbins F onto the pegs 49 of the work platform 35 from the bobbin rail 3 is essentially identical with the procedure described previously in conjunction with the first embodiment of the invention. Namely, the frame structure 42 disposed at the upper or lifted position is moved downwardly with the pegs 49 being disposed at the operative position, as shown in FIG. 20(A), whereupon the bobbin changing mechanism 13 is actuated to bring the full bobbins F to the positions corresponding to the pegs 49, as shown in FIG. 20(B). Subsequently, the frame structure 42 is moved upwardly to allow the pegs 49 to be inserted into the full bobbins F, respectively, as shown in FIG. 20(C). From this state, the bobbin changing mechanism 13 is actuated to cause the forks 30*a* and 30*b* to move to the retracted position (see FIG. 20(D).

Figure 21A:
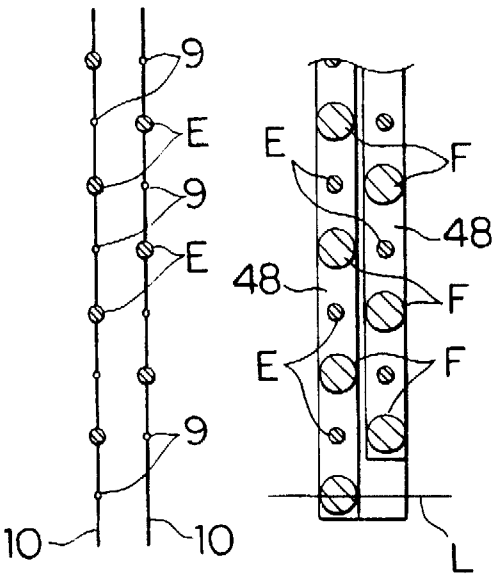
FIGS. 21A to 21C are schematic diagrams for illustrating relations between the work platform and bobbin transporting carriers in the bobbin changing apparatus according to the second embodiment.
Figure 21A:
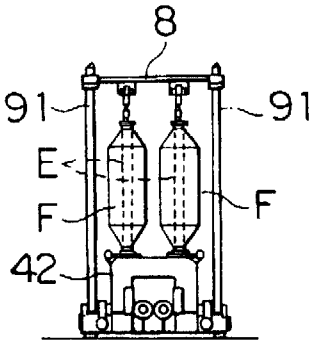
Figure 21B:
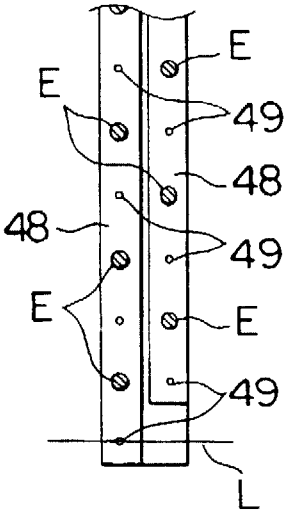
Figure 21B:
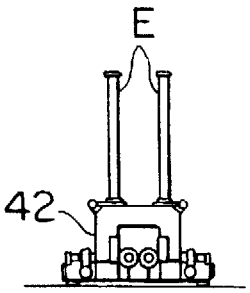
Figure 21C:
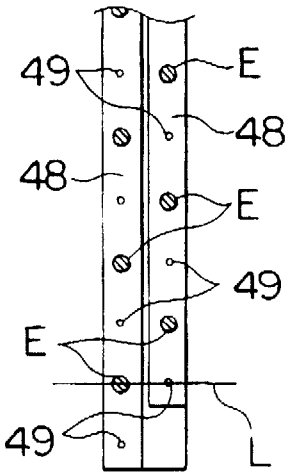
Figure 21C:
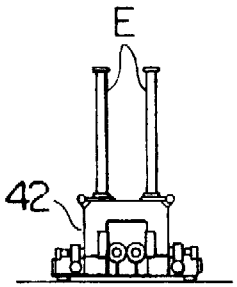

Subsequently, the guide rods 91 are disposed at the respective guide positions. Thereafter, the lift apparatus 7 is actuated to thereby dispose the supporting frame 8 at the lowered position. The pegs 49 are inserted into the empty bobbins E, respectively, while the full bobbins F are mounted on the bobbin hangers 9, respectively, as shown in FIG. 21(A). In succession, the lift apparatus is actuated to allow the supporting frame 8 to move upwardly to the original or starting position in the state suspending the full bobbins F, while the empty bobbins E are mounted onto the pegs 49, as can be seen in FIG. 21(B). After the supporting frame 8 having been disposed at the upper or lifted position, the guide-dedicated motor M4 is driven in the backward direction, whereby the guide rod 91 is disposed at the retracted position. Starting from this state, the reciprocation-dedicated motor M3 is driven in the forward direction, as a result of which the pegs 49 are moved together with the rotatable shafts 47*a* and 47*b* toward the first end portion of the frame structure 42 by the pitch (P/2) so that the empty bobbins E can assume the positions corresponding to the bobbin wheels 4, respectively, as shown in FIG. 21(C).

Figure 22A:
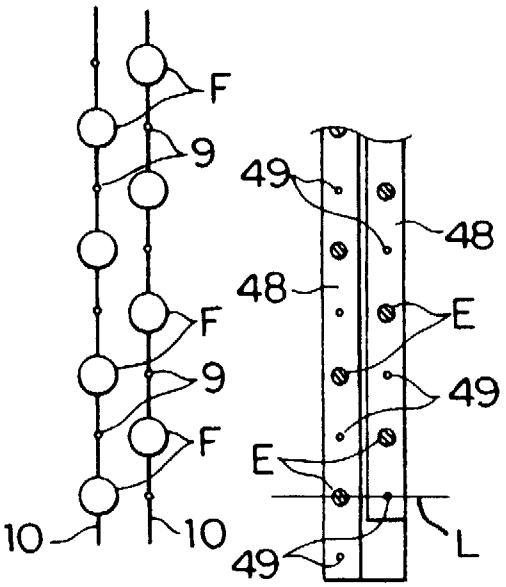
FIGS. 22A to 22C are schematic diagrams for illustrating relations between the work platform and bobbin transporting carriers in the bobbin changing apparatus according to the second embodiment.
Figure 22B:
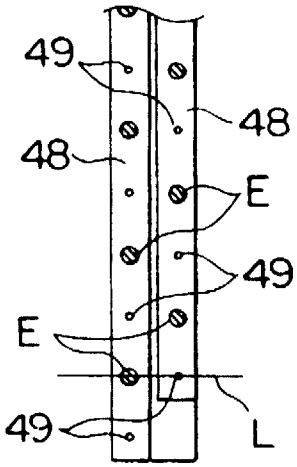
Figure 22B:
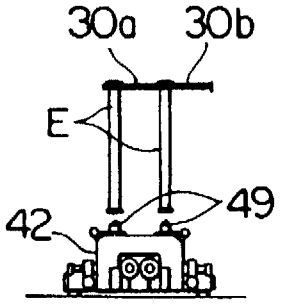
Figure 22B:
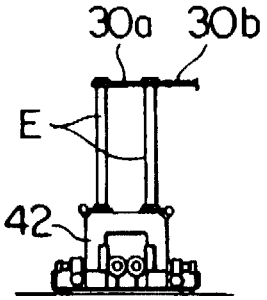
Figure 22C:
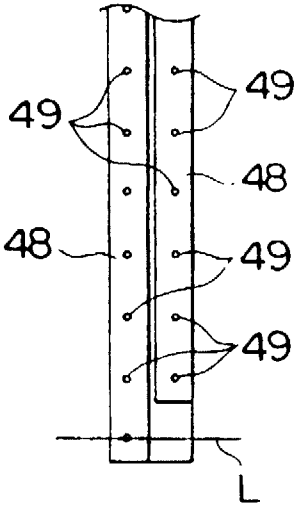
Figure 22C:
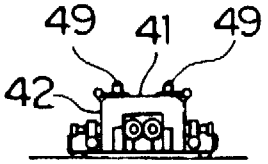
Figure 23:
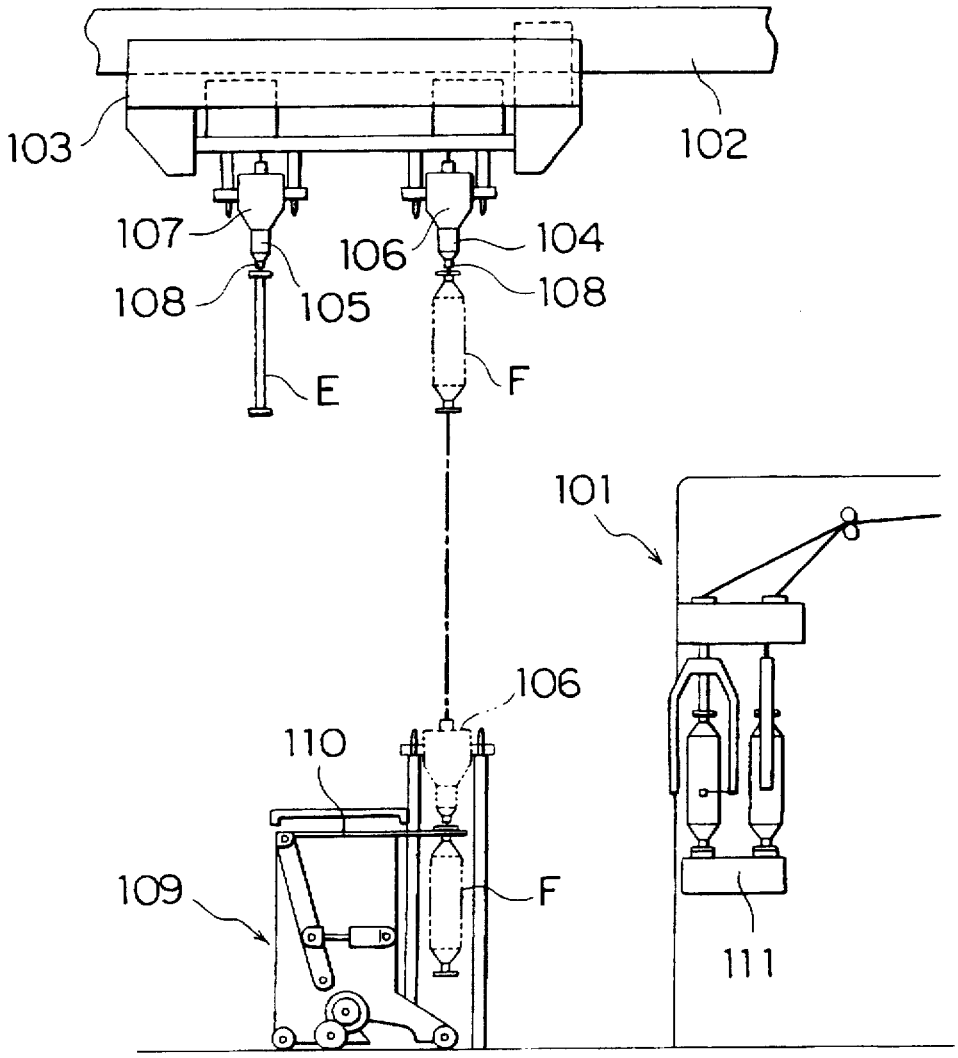
FIG. 23 is a schematic side view showing a bobbin changing apparatus known heretofore.

Now, the bobbin changing mechanism 13 is actuated to allow the forks 30*a* and 30*b* to be disposed at the forward positions corresponding to the bottom surfaces of the empty bobbins E, as show in FIG. 22(A). Starting from this state, the frame structure 42 is moved downwardly, whereby the empty bobbins E are suspended by the forks 30*a* and 30*b*, as shown in FIG. 22(B). Thereafter, the bobbin changing mechanism 13 is actuated to thereby mount the empty bobbins E on the bobbin wheels 4, which is then followed by positioning of the forks 30*a* and 30*b* at the retracted position. On the other hand, the reciprocation-dedicated motor M3 is driven in the backward or reverse direction so that the frame structure 42 can restore the original position. Refer to FIG. 22(C). Then, the pegs 49 are disposed at the retracted position with the frame 42 being disposed at the upper or lifted position. Thus, the state shown in FIG. 1 is reestablished.

As will now be appreciated from the above description, in the case of the apparatus according to the second embodiment of the invention, the full bobbins F are fit to the bobbin hangers 9 simultaneously with the fitting of the empty bobbins E onto the pegs 49 at the lowered position of the supporting frame 8. Accordingly, when compared with the apparatus according to the first embodiment of the invention in which the number of the bobbin hangers 9 is the same as that of the bobbin wheels 4, the transfer operation of the empty bobbins E and the full bobbins F between the pegs 49 on the work platform 35 and the bobbin hangers 9 of the bobbin transporting carriers 10 is much simplified and facilitated. As a result of this, control of the vertical movements of the frame structure 42 as well as the control of the reciprocative movements of the rotatable shafts 47*a* and 47*b* is simplified with the time taken for the bobbin changing operation being shortened. To say in another way, the time period during which operation of the flyer frame 2 is stopped can be shortened with the availability efficiency thereof being enhanced.

Modifications

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, modifications or versions mentioned below may be resorted to without departing from the spirit and scope of the invention.

(1) The bobbin changing mechanism may be so disposed as to straddle the work platform 35 in place of disposing it at the front side of the flyer frame 2. In that case, however, the bobbin changer will have to be so implemented as to have bobbin changing arms which are vertically movable. Accordingly, transfer of the full bobbins F and the empty bobbins E between the pegs 49 and the above-mentioned bobbin changing arms may be effectuated by moving upwardly/downwardly the arms. To this end, the transfer of the full bobbins F and the empty bobbins E between the bobbin transporting carrier 10 and the work platform 35 may be realized by moving the supporting frame 8 upwardly/downwardly under actuation of the lift apparatus 7 with the frame structure 42 of the work platform 35 being installed stationarily. The arrangement mentioned above is advantageous in that the work platform 35 can be implemented in a simplified structure.

(2) Cleaning of the cover plate 41 by the cleaning member 79 need not necessarily be effected upon every bobbin changing but may be performed once for a predetermined number of times the bobbins are changed. Besides, instead of cleaning the cover plate 41 by providing the cleaning member 79, the cleaning operation may be performed manually when the fly waste is deposited over the cover plate 41 to a given extent.

(3) Instead of providing the pegs 49 movably between the retracted position and the operative position, they may be provided stationarily at the operative position by providing additionally a movable cover plate which can exchangeably be moved between a position covering the pegs 49 from the above and a retracted position at which the pegs 49 are exposed.

(4) As the bobbin transporting carriers 10, there may be employed any other suitable bobbin transporting carrier in which supporting members suspending the bobbin hangers are interlinked to one another with an expected rove winding pitch of the spinning machine. Of course, other structure of the bobbin transporting carrier 10 may be adopted as the case may be.

(5) The positioning device 80 may be spared, if desired.

(6) The supporting rail positioning means disposed at the lowered position by the lift means may be disposed at both sides of the work platform 35. In that case, the bobbin transporting carrier suspending the empty bobbins can be disposed at the predetermined lowered position, whereby undesirable operations involved in the release of the empty bobbin from the bobbin hangers and mounting of the full bobbins onto the bobbin hangers can be suppressed to minimum.

Accordingly, all suitable modifications and equivalents may be resorted to, falling within the spirit and scope of the invention.

As can be appreciated from the foregoing description, in the apparatuses according to the present invention, the operators or workers can always attend the flyer frame at the front side thereof during operation thereof, while remedy of erroneous operation such as connection of the broken roves, erroneous automatic winding upon restarting of the frame and the like can be performed without encountering any appreciable difficulty. Further, there arises no necessity of providing the carrier rails independently for transportations of the full bobbins and the empty bobbins, respectively. Thus, the apparatus of concern can be implemented inexpensively in a miniaturized structure. In addition, because the bobbin changing mechanism is disposed in the space at the rear side of the rove frame, effective and efficient utilization of the available space can be realized. It should also be mentioned that the transfer operation of the empty bobbins with the full bobbins between the bobbin transporting carriers and the work platform as well as the control therefor can be much simplified and facilitated.

We claim:

1. A bobbin changing method for exchanging full bobbins with empty bobbins in a flyer frame, wherein: said flyer frame is equipped with top-supported flyers disposed in two parallel rows arranged in a zigzag array; a plurality of bobbin supporting members, equal in number to twice the number of bobbin wheels of said flyer frame, are disposed at a front side of said flyer frame in two rows with a pitch corresponding to one half of the pitch at which said bobbin wheels are disposed; a rigid work platform for supporting a worker is disposed so as to be movable along the longitudinal direction of said flyer frame reciprocatively for a distance corresponding to half of the pitch of said bobbin wheels, said work platform having said bobbin supporting members coupled thereto so as to allow said bobbin supporting members to be selectively exposed upwardly above said work platform or unexposed in retracted positions with respect to said work platform; and bobbin transporting carriers equipped with bobbin hangers at a pitch corresponding to half of that of said bobbin wheels are disposed on rails which extend above and along said flyer frame for suspending in a zigzag array empty bobbins for at least one flyer frame, said bobbin transporting carriers being normally disposed at a standby position, said method comprising the steps of:

exposing upwardly in a zigzag array, from their said retracted positions, said bobbin supporting members at the commencement of a bobbin changing operation;

transferring the full bobbins from a bobbin rail to said bobbin supporting members of said work platform exposed upwardly in a zigzag array by means of a bobbin changer mechanism mounted independent of said work platform for selectively moving bobbin changing arms disposed with a half pitch of said bobbin wheels reciprocatively in frontward and rearward directions orthogonally to said flyer frame; then moving said bobbin transporting carriers downwardly to thereby simultaneously place said empty bobbins, equal in number to said bobbin wheels of said flyer frame, onto those of said upwardly exposed bobbin supporting members that are not occupied by full bobbins;

moving upwardly said bobbin transporting carriers to said standby position after having simultaneously suspended all full bobbins, which were disposed on said bobbin supporting members, on the bobbin hangers of said bobbin transporting carriers;

positioning said two rows of bobbin supporting members having the empty bobbins disposed thereon in alignment with and facing said bobbin wheels; and transferring said empty bobbins to said bobbin wheels from said bobbin supporting members by employing said bobbin changing mechanism.

2. A bobbin changing apparatus for exchanging full bobbins with empty bobbins in a flyer frame having top-supported flyers disposed in two parallel rows arranged in a zigzag array in front along the length of said flyer frame;

a plurality of bobbin supporting members equal in number to twice the number of bobbin wheels of said flyer frame, said bobbin supporting members being disposed alongside said flyer frame directly in front of said rows of flyers in two rows with a pitch corresponding to half of the pitch at which said bobbin wheels are disposed;

a rigid work platform for supporting a worker disposed along with said supporting members for movement in the longitudinal direction of said flyer frame reciprocatively for a distance corresponding to half of the pitch of said bobbin wheels, said bobbin supporting members being supported on said work platform for movement from a support member unexposed retracted position with respect to said work platform to a position of upward exposure above said work platform upon a bobbin changing operation;

a bobbin changing mechanism including bobbin changing arms for grasping the bobbins and movable between a changing mechanism retracted position, a first operative position corresponding to the position of said bobbin wheels on a bobbin rail, and a second operative position corresponding to the location of said bobbin supporting members on said work platform when said bobbin supporting members are in the upwardly exposed position, said bobbin changing mechanism further including driving means for moving said bobbin changing arms selectively to said changing mechanism retracted position and said first and second operative positions;

bobbin transporting carriers disposed in front of said flyer frame higher than the top of said flyer frame and having a number of bobbin hangers, said number of bobbin hangers being equal to the number of the bobbin wheels of at least one flyer frame, said bobbin hangers being disposed in staggered relation with the same pitch as that of said bobbin wheels;

supporting rails for supporting said bobbin transporting carriers; and lift means for moving said supporting rails selectively between a lowered position at which full bobbins mounted on the bobbin supporting members of said work platform can be engaged by the bobbin hangers and an upper position at which said supporting rails are connected to transporting rails for delivering said bobbin transporting carriers to other locations.

3. A bobbin changing apparatus for the flyer frame according to claim 2, wherein said bobbin changing mechanism is disposed on the opposite side of said flyers from said work platform at a lower height than said flyers.

4. A bobbin changing apparatus for the flyer frame according to claim 3, wherein said bobbin transporting carriers are arrayed in two rows; and wherein said bobbin hangers of both rows are arranged so that a single zigzag pattern in a horizontal plane is formed with a pitch equal to that of said bobbin wheels.

5. A bobbin changing apparatus for a flyer frame according to claim 4, wherein said work platform includes a platform frame structure mounted for selective movement upwardly and downwardly by up/down moving means; a platform member secured to said platform frame structure at a top portion thereof; and rotatable shafts supported respectively, on said platform frame structure at both sides thereof extending in the longitudinal direction of said platform member; said bobbin supporting members being fixedly secured to the rotatable shafts supported for rotation with said rotatable shafts so that said bobbin supporting members can be moved between a bobbin holding position in which said bobbin supporting members are exposed upwardly overlying said platform member of said work platform and a retracted position located lower than said platform member of said work platform.

6. A bobbin changing method for exchanging full bobbins with empty bobbins in a flyer frame, wherein: said flyer frame is equipped with top-supported flyers disposed in two parallel rows arranged in a zigzag array; a plurality of bobbin supporting members, equal in number to twice the number of bobbin wheels of said flyer frame, are disposed at a front side of said flyer frame in two rows with a pitch corresponding to one half of the pitch at which said bobbin wheels are disposed; a work platform for supporting a worker and having said bobbin supporting members coupled thereto is disposed at the front side of said flyer frame so as to allow said bobbin supporting members to be selectively exposed upwardly above said work platform or unexposed in retraced positions with respect to said work platform; and bobbin transporting carriers equipped with bobbin hangers at a pitch corresponding to half of that of said bobbin wheels are disposed on rails which extend above and along said flyer frame for suspending in a zigzag array empty bobbins for at least one flyer frame, said bobbin transporting carriers being normally disposed at a standby position, said method comprising the steps of:

exposing upwardly in a zigzag array, from their said retracted positions, said bobbin supporting members at the commencement of a bobbin changing operation;

transferring the full bobbins from a bobbin rail to said bobbin supporting members of said work platform exposed upwardly in a zigzag array by means of a bobbin changer mechanism mounted independent of said work platform for selectively moving bobbin changing arms disposed with a half pitch of said bobbin wheels reciprocatively in frontward and rearward directions orthogonally to said flyer frame; then moving said bobbin transporting carriers downwardly to thereby simultaneously place said empty bobbins, equal in number to said bobbin wheels of said flyer frame, onto those of said bobbin supporting members that are not occupied by full bobbins;

moving upwardly said bobbin transporting carriers to said standby position after having simultaneously suspended all full bobbins, which are disposed on said bobbin supporting members, on the bobbin hangers of said bobbin transporting carriers;

positioning said two rows of bobbin supporting members having the empty bobbins disposed thereon in alignment with and facing said bobbin wheels; and transferring said empty bobbins to said bobbin wheels from said bobbin supporting members by employing said bobbin changing mechanism.

7. A bobbin changing apparatus for exchanging full bobbins with empty bobbins in a flyer frame having topsupported flyers disposed in two parallel rows arranged in a zigzag array in front along the length of said flyer frame;

a plurality of bobbin supporting members equal in number to twice the number of bobbin wheels of said flyer frame, said bobbin supporting members being disposed alongside said flyer frame directly in front of said rows of flyers in two rows with a pitch corresponding to half of the pitch at which said bobbin wheels are disposed;

a rigid work platform for supporting a worker disposed along with said bobbin supporting members at the front side of said flyer frame, said bobbin supporting members being supported on said work platform for movement from a support member unexposed retracted position with respect to said work platform to a position of upward exposure above said work platform upon a bobbin changing operation;

a bobbin changing mechanism including bobbin changing arms for grasping the bobbins and movable between a retracted position, a first operative position corresponding to the position of said bobbin wheel on a bobbin rail, and a second operative position corresponding to the location of said bobbin supporting members on said work platform, said bobbin changing mechanism further including driving means for moving said bobbin changing arms selectively to said changing mechanism retracted position and said first and second operative positions;

bobbin transporting carriers disposed in front of said flyer frame higher than the top of said flyer frame and having a number of bobbin hangers, said number of bobbin hangers being equal to twice the number of the bobbin wheels of at least one flyer frame, said bobbin hangers being disposed in staggered relation with a half pitch of that of said bobbin wheels;

supporting rails for supporting said bobbin transporting carriers; and lift means for moving said supporting rails selectively between a lowered position at which full bobbins mounted on the bobbin supporting members of said work platform can be engaged by the bobbin hangers and an upper position at which said supporting rails are connected to transporting rails for delivering said bobbin transporting carriers to other locations.

* * * * *

UNITED STATES PATENT AND TRADEMARK OFFICE

CERTIFICATE OF CORRECTION

PATENT NO. : 5,797,255

DATED : August 25, 1998

INVENTOR(S) : Saito, et al

It is certified that error appears in the above-identified patent and that said Letters Patent is hereby corrected as shown below:

On Title Page, between " [22]" and " [51]" insert --[30] Foreign Application Priority Data October 14, 1994 [JP] Japan 6-249765--.

Column 12, line 32, after " (FIG. 1)" insert a (comma) --,--;

line 33, after " (FIG. 1)" insert a (comma) --,--.

Column 21, line 30, change " retraced" to --retracted--.

UNITED STATES PATENT AND TRADEMARK OFFICE

CERTIFICATE OF CORRECTION

PATENT NO. : 5,797,255 Page 2 of 2

DATED : August 25, 1998

INVENTOR(S) : Saito, et al

It is certified that error appears in the above-identified patent and that said Letters Patent is hereby corrected as shown below:

Column 22, line 10 and 11, change "topsup-ported" to -- top-supported--.

Signed and Sealed this

Second Day of March, 1999

*Attest:*

*Attesting Officer*

Q. TODD DICKINSON

*Acting Commissioner of Patents and Trademarks*